US009198273B2

(12) United States Patent
Igarashi et al.

(10) Patent No.: US 9,198,273 B2
(45) Date of Patent: Nov. 24, 2015

(54) EXTREME ULTRAVIOLET LIGHT GENERATION APPARATUS

(71) Applicant: GIGAPHOTON INC., Tochigi (JP)

(72) Inventors: Miwa Igarashi, Tochigi (JP); Yukio Watanabe, Tochigi (JP); Kouji Ashikawa, Tochigi (JP); Norio Iwai, Tochigi (JP); Osamu Wakabayashi, Tochigi (JP)

(73) Assignee: GIGAPHOTON INC., Tochigi (JP)

( * ) Notice: Subject to any disclaimer, the term of this patent is extended or adjusted under 35 U.S.C. 154(b) by 0 days.

(21) Appl. No.: 14/339,172

(22) Filed: Jul. 23, 2014

(65) Prior Publication Data

US 2014/0332700 A1 Nov. 13, 2014

Related U.S. Application Data

(63) Continuation of application No. PCT/IB2012/002714, filed on Dec. 13, 2012.

(30) Foreign Application Priority Data

Jan. 26, 2012 (JP) ..... 2012-014248
Oct. 16, 2012 (JP) ..... 2012-228764

(51) Int. Cl.
*G21K 5/04* (2006.01)
*H05G 2/00* (2006.01)
*G21K 5/10* (2006.01)

(52) U.S. Cl.
CPC ..... *H05G 2/008* (2013.01); *G21K 5/10* (2013.01); *H05G 2/003* (2013.01)

(58) Field of Classification Search
USPC ..... 250/493.1, 494.1, 504 R
See application file for complete search history.

(56) References Cited

U.S. PATENT DOCUMENTS

| | | | | |
|---|---|---|---|---|
| 6,194,733 | B1 | 2/2001 | Haas et al. | |
| 2008/0087847 | A1* | 4/2008 | Bykanov et al. | 250/504 R |
| 2009/0261277 | A1* | 10/2009 | Soumagne et al. | 250/504 R |
| 2010/0051832 | A1 | 3/2010 | Nishisaka et al. | |
| 2010/0117009 | A1 | 5/2010 | Moriya et al. | |
| 2011/0140008 | A1 | 6/2011 | Bergstedt et al. | |
| 2011/0141865 | A1 | 6/2011 | Senekerimyan et al. | |

OTHER PUBLICATIONS

International Search Report dated Jan. 8, 2013 for Application No. PCT/IB2012/002714.

International Preliminary Examination Report on Patentability issued in International Application No. PCT/IB2012/002714 dated Aug. 7, 2014.

* cited by examiner

*Primary Examiner* — Nicole Ippolito
(74) *Attorney, Agent, or Firm* — Studebaker & Brackett PC

(57) ABSTRACT

An apparatus for generating extreme ultraviolet light may include a reference member, a chamber fixed to the reference member, the chamber including at least one window, a laser beam introduction optical system configured to introduce an externally supplied laser beam into the chamber through the at least one window, and a positioning mechanism configured to position the laser beam introduction optical system to the reference member.

16 Claims, 15 Drawing Sheets

EXTREME ULTRAVIOLET LIGHT GENERATION APPARATUS

CROSS-REFERENCE TO RELATED APPLICATIONS

This present application is a continuation of U.S. National Phase PCT/IB2012/002714 filed Dec. 13, 2012, which claims priority from Japanese Application No. 2012-014248 filed Jan. 26, 2012, and Japanese Patent Application No. 2012-228764 filed Oct. 16, 2012, the entire disclosure of which is incorporated herein by reference for all purposes.

BACKGROUND

1. Technical Field

The present disclosure relates to apparatuses for generating extreme ultraviolet (EUV) light.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

An apparatus according to one aspect of the present disclosure for generating extreme ultraviolet light may include a reference member, a chamber fixed to the reference member, the chamber including at least one window, a laser beam introduction optical system configured to introduce an externally supplied laser beam into the chamber through the at least one window, and a positioning mechanism configured to position the laser beam introduction optical system to the reference member.

BRIEF DESCRIPTION OF THE DRAWINGS

Hereinafter, selected embodiments of the present disclosure will be described with reference to the accompanying drawings.

DETAILED DESCRIPTION

Figure 1:
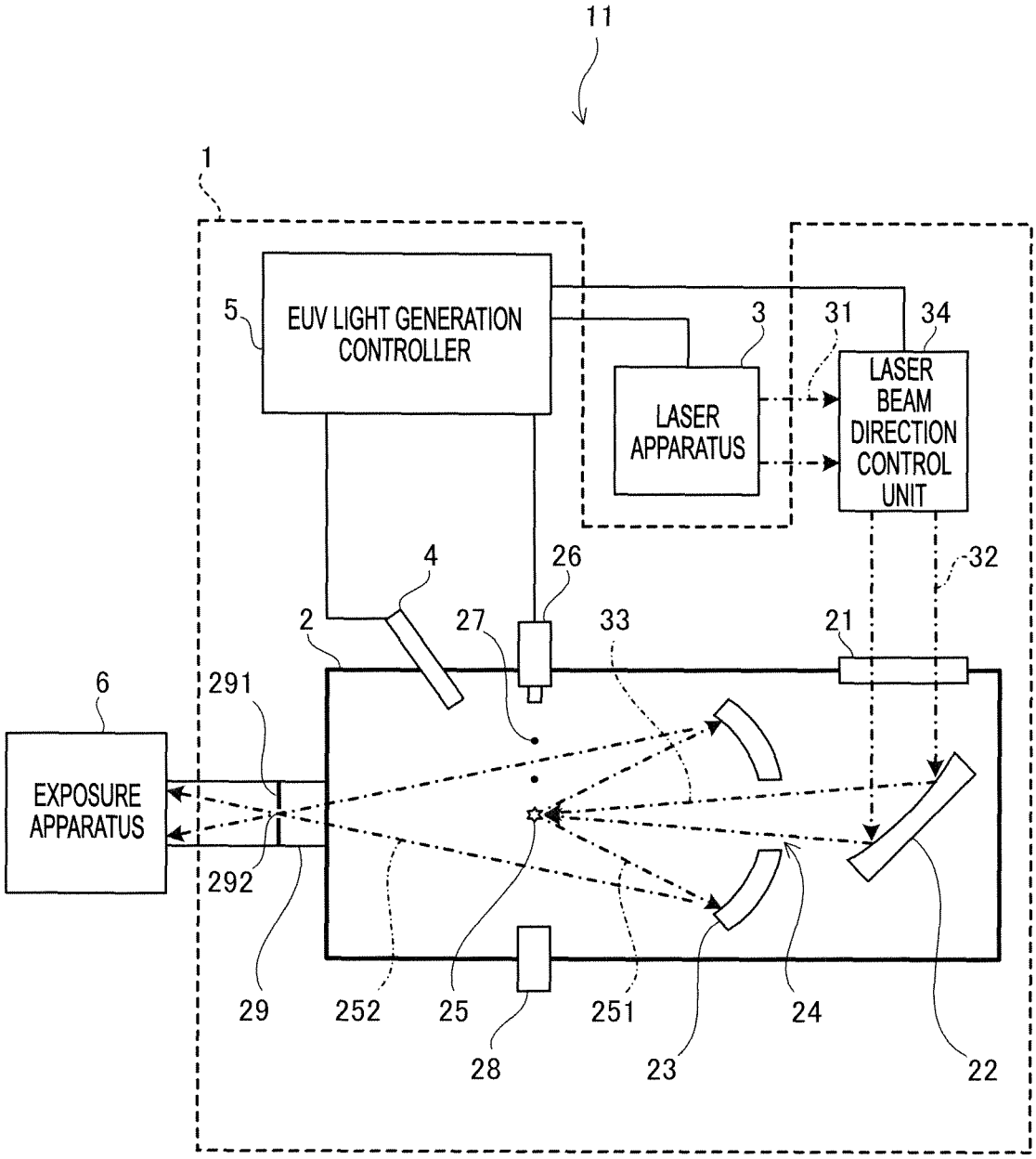
FIG. 1 schematically illustrates a configuration of an exemplary LPP-type EUV light generation system.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

CONTENTS

1. Overview
2. Overview of EUV Light Generation System
2.1 Configuration
2.2 Operation
3. EUV Light Generation System in which Laser Beam Introduction Optical System Is Positioned: First Embodiment
3.1 Configuration
3.2 Operation
4. Examples of Positioning Mechanism
4.1 Second Embodiment
4.2 Third Embodiment
4.3 Fourth Embodiment
5. Examples of Optical Elements
5.1 Fifth Embodiment
5.2 Sixth Embodiment
6. Examples of Moving Mechanism
6.1 Seventh Embodiment
6.2 Eighth Embodiment
6.3 Ninth Embodiment
6.4 Tenth Embodiment
6.5 Eleventh Embodiment
7. EUV Light Generation System Including Pre-pulse Laser Apparatus: Twelfth Embodiment
7.1 Configuration and Operation
7.1 Details of Laser Beam Measuring Unit
8. EUV Light Generation Apparatus in which Laser Beam Introduction Optical System Is Housed in Box: Thirteenth Embodiment

1. OVERVIEW

In an LPP-type EUV light generation system, a target material may be irradiated with a laser beam outputted from a laser apparatus. Upon being irradiated with the laser beam, the target material may be turned into plasma, and light including EUV light may be emitted from the plasma. The emitted EUV light may be collected by an EUV collector mirror provided in the chamber and supplied to an external apparatus such as an exposure apparatus.

A laser beam introduction optical system for introducing the laser beam into the chamber may preferably be positioned with high precision. If the laser beam introduction optical system is not positioned with high precision, a target material may not be irradiated with the laser beam, and an output of EUV light may become unstable. Further, a target material may preferably be irradiated with the laser beam at a predetermined position inside the chamber which coincides with a focus of the EUV collector mirror, so that the emitted EUV light is supplied to the exposure apparatus constantly at a desired angle.

According to one or more embodiments of the present disclosure, an EUV collector mirror and a laser beam introduction optical system may be fixed to a reference member such that respective focuses of the EUV collector mirror and the laser beam introduction optical system coincide with each other. Accordingly, the EUV collector mirror and the laser beam introduction optical system may be positioned to each other with high precision.

2. OVERVIEW OF EUV LIGHT GENERATION SYSTEM

2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 26. The chamber 2 may be sealed airtight. The target supply device 26 may be mounted onto the chamber 2, for example, to penetrate a wall of the chamber 2. A target material to be supplied by the target supply device 26 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4.

The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture may be provided in the connection part 29. The wall 291 may be positioned such that the second focus of the EUV collector mirror 23 lies in the aperture formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 31 travels, and the position at which the pulse laser beam 33 is focused. It will be appreciated that the various controls mentioned above are merely examples, and other controls may be added as necessary.

3. EUV LIGHT GENERATION SYSTEM IN WHICH LASER BEAM INTRODUCTION OPTICAL SYSTEM IS POSITIONED: FIRST EMBODIMENT

3.1 Configuration

Figure 2A:
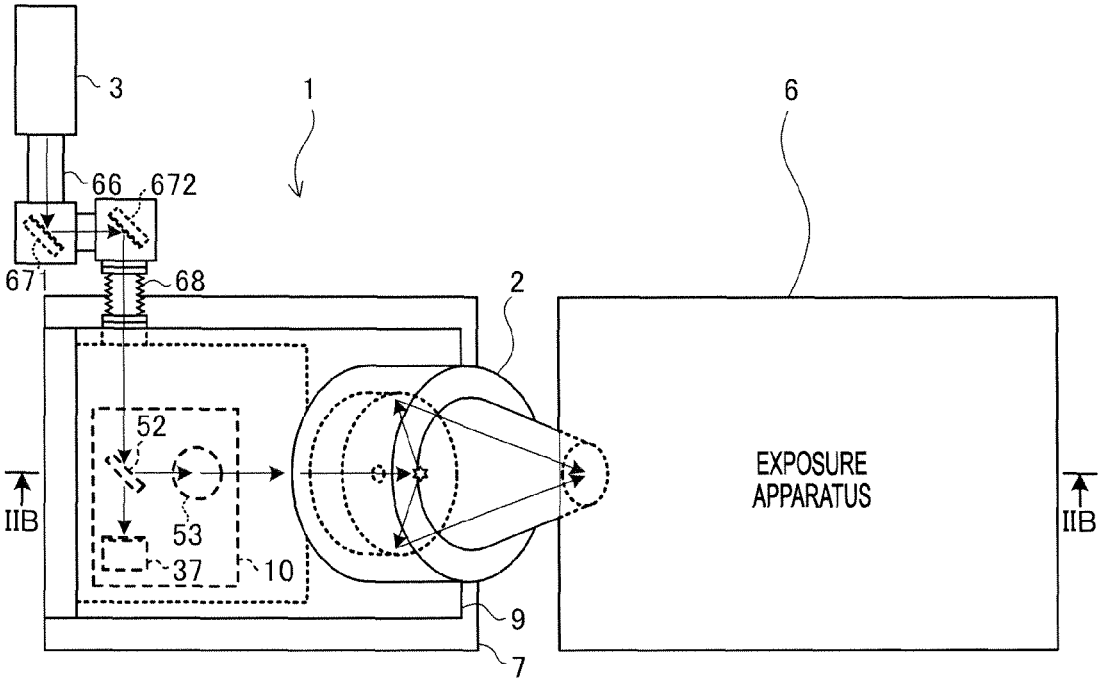
FIG. 2A is a plan view illustrating an exemplary EUV light generation apparatus according to a first embodiment of the present disclosure connected to an exposure apparatus.
Figure 2B:
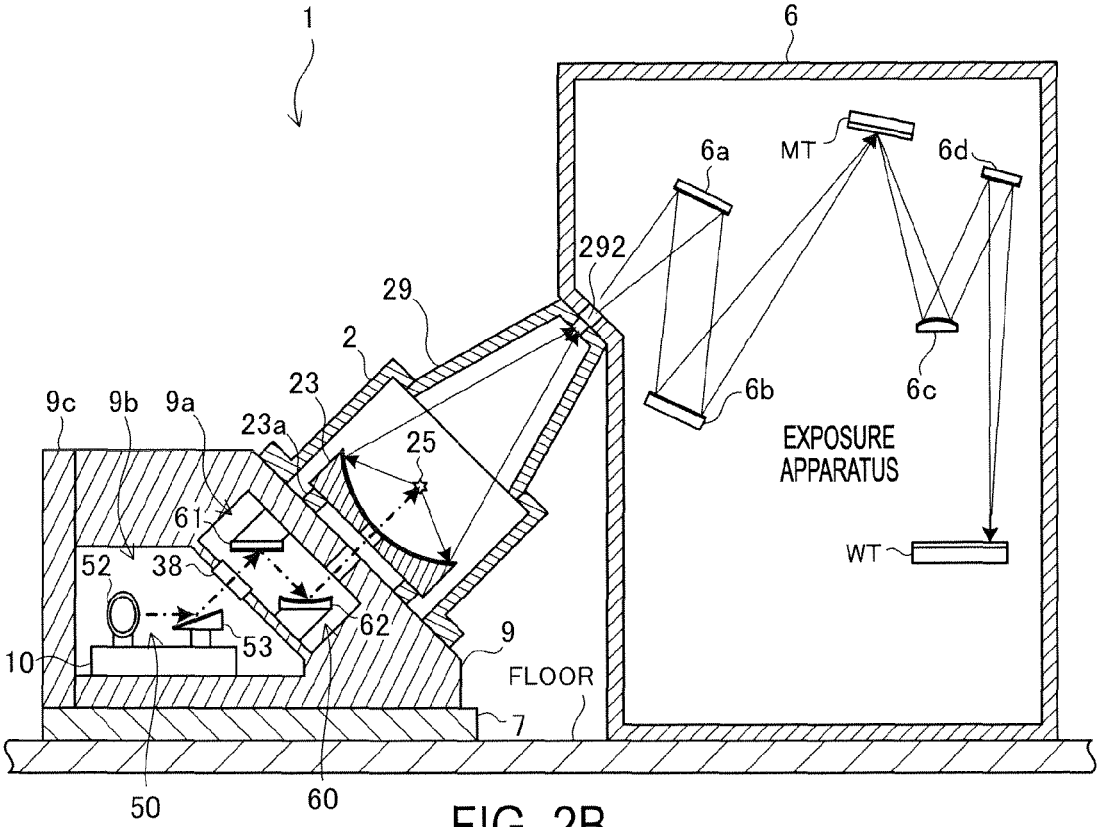
FIG. 2B is a sectional view of the EUV light generation apparatus and the exposure apparatus shown in FIG. 2A, taken along IIB-IIB plane.

FIG. 2A is a plan view illustrating an EUV light generation apparatus according to a first embodiment of the present disclosure connected to an exposure apparatus. FIG. 2B is a sectional view of the EUV light generation apparatus and the exposure apparatus shown in FIG. 2A, taken along IIB-IIB plane.

As shown in FIGS. 2A and 2B, an EUV light generation apparatus 1 may include an installation mechanism 7, a reference member 9, and a chamber 2. A surface of a floor shown in FIG. 2B may serve as a mechanical reference plane on which the EUV light generation apparatus 1 and an exposure apparatus 6 are installed. The reference member 9 may be supported by the installation mechanism 7 installed on the floor serving as the mechanical reference plane. The installation mechanism 7 may include a mechanism (not separately shown) to move the reference member 9 relative to the installation mechanism 7, and the reference member 9 and the chamber 2 may be movable relative to the exposure apparatus 6 through the aforementioned mechanism included in the installation mechanism 7. The installation mechanism 7 may also include another mechanism (not separately shown) to position the reference member 9 relative to the exposure apparatus 6. Through these mechanisms, the reference member 9 may first be positioned relative to the exposure apparatus 6. The reference member 9 may have a flow channel (not separately shown) formed therein, through which a heat carrier may flow to retain the temperature of the reference member 9 substantially constant.

The chamber 2 may be substantially cylindrical in shape. The chamber 2 may be mounted to the reference member 9 such that one end in the axial direction of the chamber 2 is covered by the reference member 9 (see FIG. 2B). For example, a sloped surface may be formed on the reference member 9, and the chamber 2 may be fixed to the sloped surface of the reference member 9 so that the other end of the chamber 2 faces the exposure apparatus at a predetermined angle. A connection part 29 may be connected to the other end of the chamber 2 to connect the chamber 2 to the exposure apparatus 6.

As discussed, the target supply device 26 (see FIG. 1) may be fixed to the chamber 2 to supply targets to the plasma generation region 25 in the chamber 2.

The EUV collector mirror 23 may be fixed to the reference member 9 through an EUV collector mirror mount 23*a*. The EUV collector mirror 23 may be fixed to the reference member 9 such that the first focus of the EUV collector mirror 23 lies in the plasma generation region 25 and the second focus thereof coincides with the intermediate focus 292 specified by the exposure apparatus 6. Since the reference member 9 is positioned relative to the exposure apparatus 6 and fixed through a stopper (not separately shown), a variation in the position and/or posture of the EUV collector mirror 23, which is fixed to the reference member 9, relative to the exposure apparatus 6 may be suppressed.

A housing chamber 9*a* that is in communication with the chamber 2 through a through-hole and a housing chamber 9*b* adjacent to the housing chamber 9*a* may be formed in the reference member 9. A window 38 may be provided between the housing chamber 9*a* and the housing chamber 9*b*. Thus, the interior of the chamber 2 and the housing chamber 9*a* may be kept at a low pressure. A lid 9*c* may be operably provided in the housing chamber 9*b* to seal the housing chamber 9*b*.

A laser beam focusing optical system 60 that includes a high-reflection mirror 61 and a laser beam focusing mirror 62 may be provided in the housing chamber 9*a*. The laser beam focusing mirror 62 may be an off-axis paraboloidal mirror. A laser beam introduction optical system 50 that includes a beam splitter 52 and a high-reflection mirror 53 may be provided in the housing chamber 9*b*. A laser beam measuring unit 37 may further be provided in the housing chamber 9*b*.

The high-reflection mirror 61 and the laser beam focusing mirror 62 may be fixed to the reference member 9 through respective holders. The high-reflection mirror 61 and the laser beam focusing mirror 62 may be positioned such that a laser beam incident on the high-reflection mirror 61 is reflected thereby toward the laser beam focusing mirror 62 at a predetermined angle and the laser beam from the high-reflection mirror 61 is reflected by the laser beam focusing mirror 62 to be focused in the plasma generation region 25, where the first focus of the EUV collector mirror 23 lies. In this way, the laser beam focusing optical system 60 and the EUV collector mirror 23 may be fixed to the reference member 9 in the above-described positional relationship, and the reference member 9 may then be positioned to the exposure apparatus 6. Accordingly, EUV light emitted in the plasma generation region 25 may stably be supplied to the exposure apparatus 6 at a desired angle.

The beam splitter 52 and the high-reflection mirror 53 may also be fixed to the reference member 9. The beam splitter 52 and the high-reflection mirror 53 may be positioned such that a laser beam that has entered the housing chamber 9*b* is first incident on the beam splitter 52 and the laser beam reflected by the beam splitter 52 is incident on the high-reflection mirror 53 at a predetermined angle. This predetermined angle may be set such that the laser beam reflected by the high-reflection mirror 53 is incident on the high-reflection mirror 61 provided inside the housing chamber 9*a*. In this way, the laser beam introduction optical system 50 may be fixed to the reference member 9 and positioned relative to the laser beam focusing optical system 60, and thus a variation in the position and/or the posture of the laser beam introduction optical system 50 relative to the laser beam focusing optical system 60 may be suppressed. Accordingly, the position and/or the angle at which the laser beam enters the laser beam focusing optical system 60 may be set precisely.

In addition, the laser beam measuring unit 37 may be fixed to the reference member 9. The laser beam measuring unit 37 may be positioned such that the laser beam transmitted through the beam splitter 52 enters the laser beam measuring unit 37. In this way, the laser beam measuring unit 37 may be fixed to the reference member 9 and positioned relative to the laser beam introduction optical system 50, and thus a variation in the position and/or the posture of the laser beam measuring unit 37 relative to the laser beam introduction optical system 50 may be suppressed. Accordingly, a beam intensity profile, pointing, and divergence of a laser beam that enters the laser beam measuring unit 37 from the laser beam introduction optical system 50 may constantly be measured with high precision.

The beam splitter 52, the high-reflection mirror 53, and the laser beam measuring unit 37 may be positioned and fixed to the reference member 9 through a positioning mechanism 10. The positioning mechanism 10 may serve to position optical elements such as the beam splitter 52 to the reference member 9, and the configuration thereof is not particularly limited to those described in the subsequent embodiments.

An optical pipe 66 may be attached to the reference member 9 through a flexible pipe 68. High-reflection mirrors 671 and 672 may be provided in the optical pipe 66. The optical pipe 66 may also be connected to a laser apparatus 3.

The exposure apparatus 6 may include a plurality of high-reflection mirrors 6*a* through 6*d*. A mask table MT and a workpiece table WT may be provided in the exposure apparatus 6. In the exposure apparatus 6, a mask on the mask table MT may be irradiated with EUV light to project an image on the mask onto a workpiece such as a semiconductor wafer on the workpiece table WT. By transitionally moving the mask table MT and the workpiece table WT simultaneously, the pattern on the mask may be transferred onto the workpiece.

3.2 Operation

A laser beam outputted from the laser apparatus 3 may be reflected sequentially by the high-reflection mirrors 671 and 672 to enter the housing chamber 9*b* of the reference member 9.

The laser beam that has entered the housing chamber 9*b* may be incident on the beam splitter 52. The beam splitter 52 may be positioned to reflect the laser beam incident thereon with high reflectance toward the high-reflection mirror 53 and transmit a part of the laser beam toward the laser beam measuring unit 37. The high-reflection mirror 53 may reflect the laser beam from the beam splitter 52 to guide the laser beam into the housing chamber 9*a* through the window 38.

The laser beam that has entered the housing chamber 9*a* may be incident on the high-reflection mirror 61. The high-reflection mirror 61 may be positioned to reflect the laser beam incident thereon toward the laser beam focusing mirror 62. The laser beam focusing mirror 62 may be positioned to focus the laser beam from the high-reflection mirror 61 in the plasma generation region 25. In the plasma generation region 25, a target supplied from the target supply device 26 (see FIG. 1) may be irradiated with the laser beam, and the target is turned into plasma from which light including EUV light may be emitted.

As described above, in the first embodiment, the laser beam introduction optical system 50 that includes the beam splitter 52 and the high-reflection mirror 53 may be fixed and positioned to the reference member 9 through the positioning mechanism 10 relative to the laser beam focusing optical system 60. The laser beam focusing optical system 60 may then be positioned relative to the EUV collector mirror 23, which in turn may be positioned relative to the exposure apparatus 6 with the plasma generation region 25 and the intermediate focus 292 serving as references. Accordingly, a target may be irradiated with the laser beam with high precision, and emitted EUV light may stably be supplied to the exposure apparatus 6.

4. EXAMPLES OF POSITIONING MECHANISM

4.1 Second Embodiment

Figure 3A:
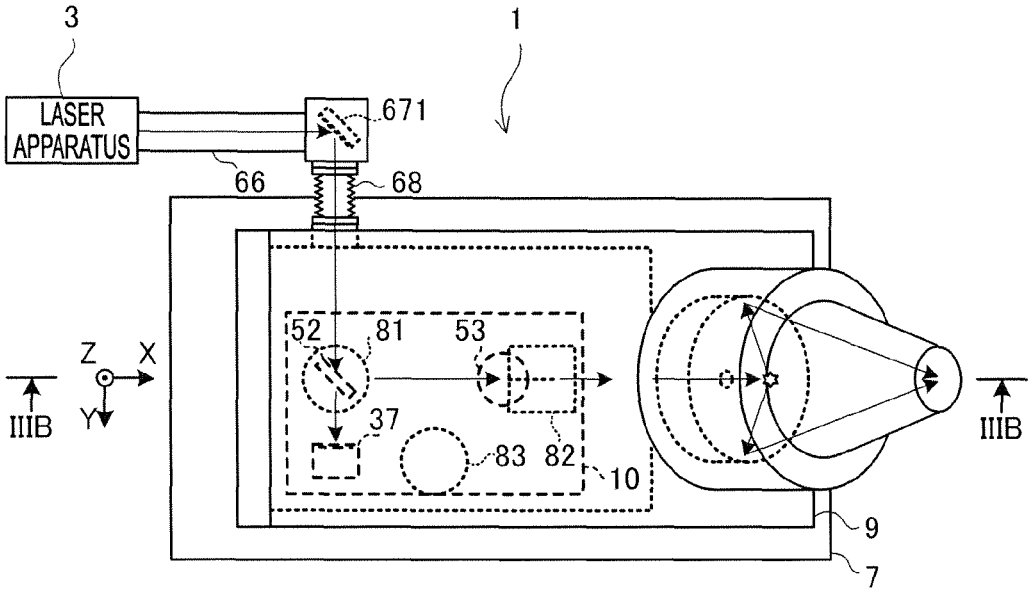
FIG. 3A is a plan view illustrating an exemplary EUV light generation apparatus according to a second embodiment of the present disclosure.
Figure 3B:
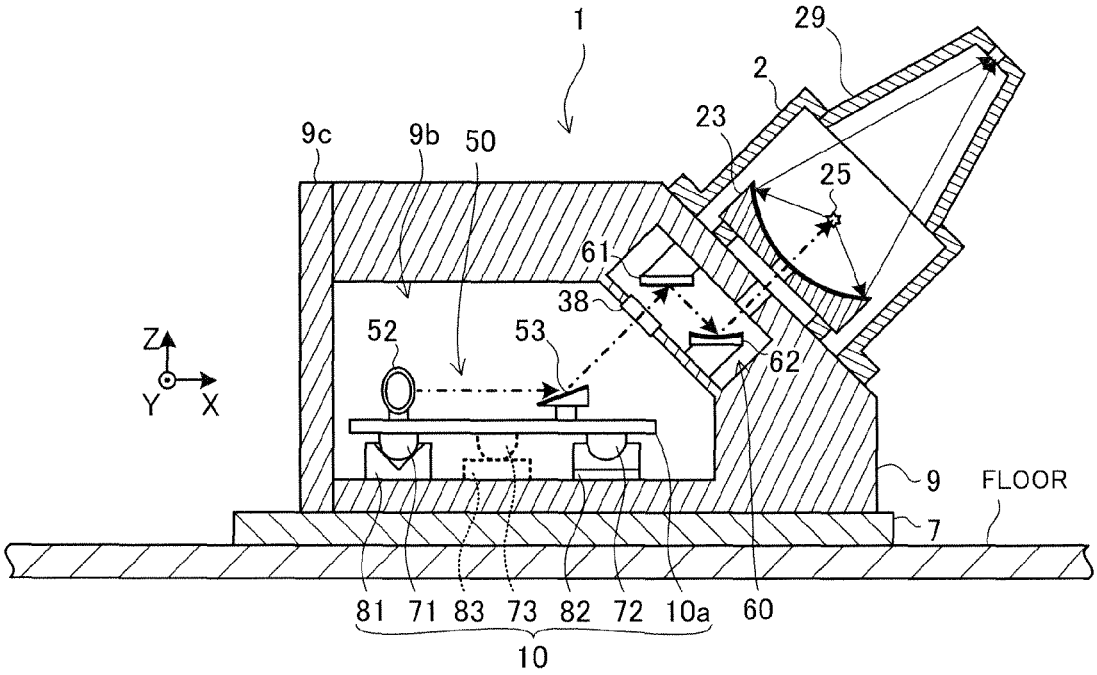
FIG. 3B is a sectional view of the EUV light generation apparatus shown in FIG. 3A, taken along IIIB-IIIB plane.

FIG. 3A is a plan view illustrating an EUV light generation apparatus according to a second embodiment of the present disclosure. FIG. 3B is a sectional view of the EUV light generation apparatus shown in FIG. 3A, taken along plane.

As shown in FIGS. 3A and 3B, the positioning mechanism 10 for positioning the beam splitter 52, the high-reflection mirror 53, and the laser beam measuring unit 37 to the reference member 9 may include a support plate 10*a*. The beam splitter 52, the high-reflection mirror 53, and the laser beam measuring unit 37 may be supported on the upper surface of the support plate 10*a* through respective holders. The laser beam measuring unit 37 is not shown in FIG. 3B. Three legs 71 through 73 may be attached on the lower surface of the support plate 10*a* to support the support plate 10*a* at three points. The lower end of each of the legs 71 through 73 may be hemispherical in shape. The leg 71 may be provided at a position directly underneath the beam splitter 52. The leg 72 may be provided at a position distanced from the leg 71 in a direction in which a laser beam travels from the beam splitter 52 to the high-reflection mirror 53. The leg 72 may be provided directly underneath the beam axis of the laser beam. The leg 73 may be provided at a position distanced in the Y-direction from an imaginary line connecting the leg 71 and the leg 72.

The positioning mechanism 10 may further include mounts 81 through 83, on which the legs 71 through 73 are placed, respectively. The mounts 81 through 83 may be fixed in the housing chamber 9*b* of the reference member 9. The legs 71 through 73 may be placed on the respective mounts 81 through 83, and thus the support plate 10*a* may be supported on the reference member 9.

A conical recess may be formed on the upper surface of the mount 81. A V-shaped groove may be formed on the upper surface of the mount 82. The groove in the mount 82 may be formed in a direction parallel to the beam axis of the laser beam from the beam splitter 52 to the high-reflection mirror 53. The upper surface of the mount 83 may be planar.

The leg 71 may be placed on the mount 81 having a conical recess, and thus the leg 71 may be restricted from moving along the XY plane. The leg 72 may be placed on the mount 82 having a V-shaped groove, and thus the leg 72 may be supported movably in the X-direction. That is, the leg 72 may be supported movably along the direction in which the laser beam travels from the beam splitter 52 to the high-reflection mirror 53. The leg 73 may be placed on the mount 83, and thus the leg 73 may be supported movably along the XY plane.

Through the above-described configuration, even if the support plate 10*a* deforms due to thermal expansion, the direction of the laser beam may be prevented from being changed inside the housing chamber 9*b*. Because of shapes of the mounts 81 through 83, for example, the support plate 10*a* may be allowed to expand along the path of the laser beam. Thus, the laser beam introduction optical system 50 may be positioned with precision relative to the laser beam focusing optical system 60 and the plasma generation region 25. Accordingly, a target may be irradiated with the laser beam with high precision, and an output of EUV light may be stabilized.

4.2 Third Embodiment

Figure 4A:
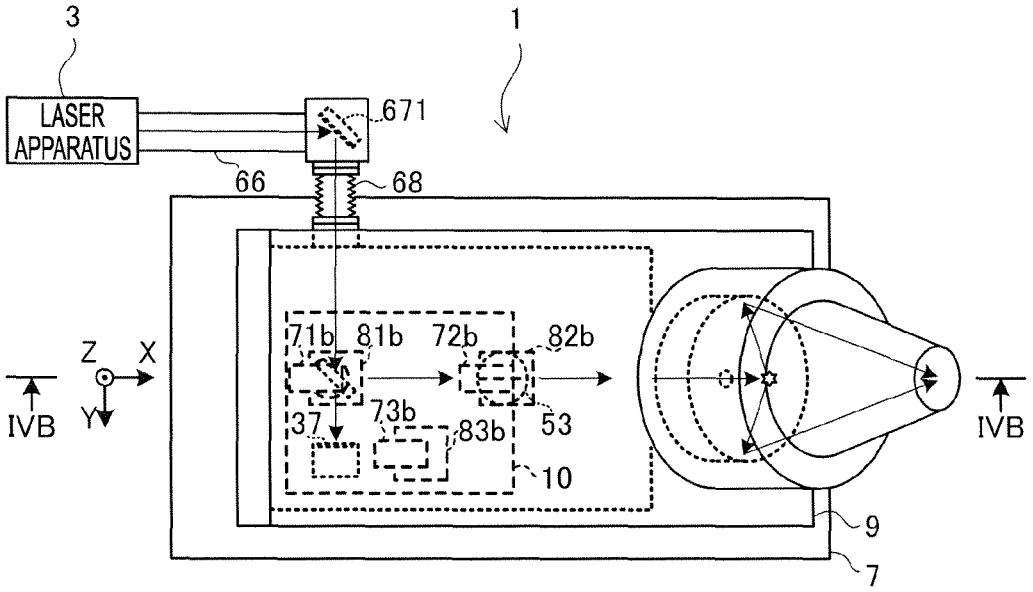
FIG. 4A is a plan view illustrating an exemplary EUV light generation apparatus according to a third embodiment of the present disclosure.
Figure 4B:
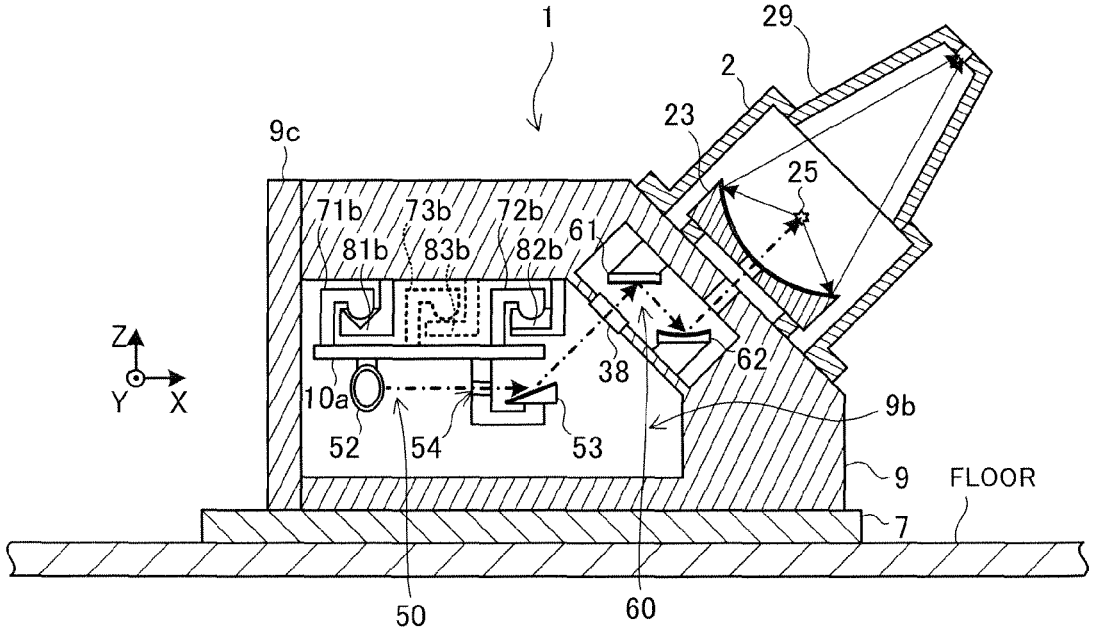
FIG. 4B is a sectional view of the EUV light generation apparatus shown in FIG. 4A, taken along IVB-IVB plane.

FIG. 4A is a plan view illustrating an EUV light generation apparatus according to a third embodiment of the present disclosure. FIG. 4B is a sectional view of the EUV light generation apparatus shown in FIG. 4A, taken along IVB-IVB plane.

In the third embodiment, the beam splitter 52, the high-reflection mirror 53, and the laser beam measuring unit 37 may be supported on the lower surface of the support plate 10*a* through respective holders. The laser beam measuring unit 37 is not shown in FIG. 4B. A through-hole 54 may be formed in the holder supporting the high-reflection mirror 53 through which a laser beam may pass. Hooks 71*b* through 73*b* may be attached on the upper surface of the support plate 10*a*. Each of the hooks 71*b* through 73*b* may have a hemispherical projection. The hook 71*b* may be provided such that the hemispherical projection thereof is located directly above the beam splitter 52. The hook 72*b* may be provided such that the hemispherical projection thereof is located at a position distanced from the hook 71*b* in a direction in which a laser beam travels from the beam splitter 52 to the high-reflection mirror 53. The hemispherical projection of the hook 72*b* may be located directly above the beam axis of the laser beam. The hook 73*b* may be provided at a position distanced in the Y-direction from an imaginary line connecting the hook 71*b* and the hook 72*b*.

The positioning mechanism 10 may include mounts 81*b* through 83*b*, on which the hooks 71*b* through 73*b* are placed, respectively. The mounts 81*b* through 83*b* may be suspended and fixed inside the housing chamber 9*b* of the reference member 9. The hooks 71*b* through 73*b* may be placed on the respective mounts 81*b* through 83*b*, and thus the support plate 10*a* may be supported by the reference member 9.

A conical recess may be formed on the upper surface of the mount 81*b*. A V-shaped groove may be formed on the upper surface of the mount 82*b*. The groove in the mount 82*b* may be formed in a direction parallel to the beam axis of the laser beam from the beam splitter 52 to the high-reflection mirror 53. The upper surface of the mount 83*b* may be planar.

4.3 Fourth Embodiment

Figure 5A:
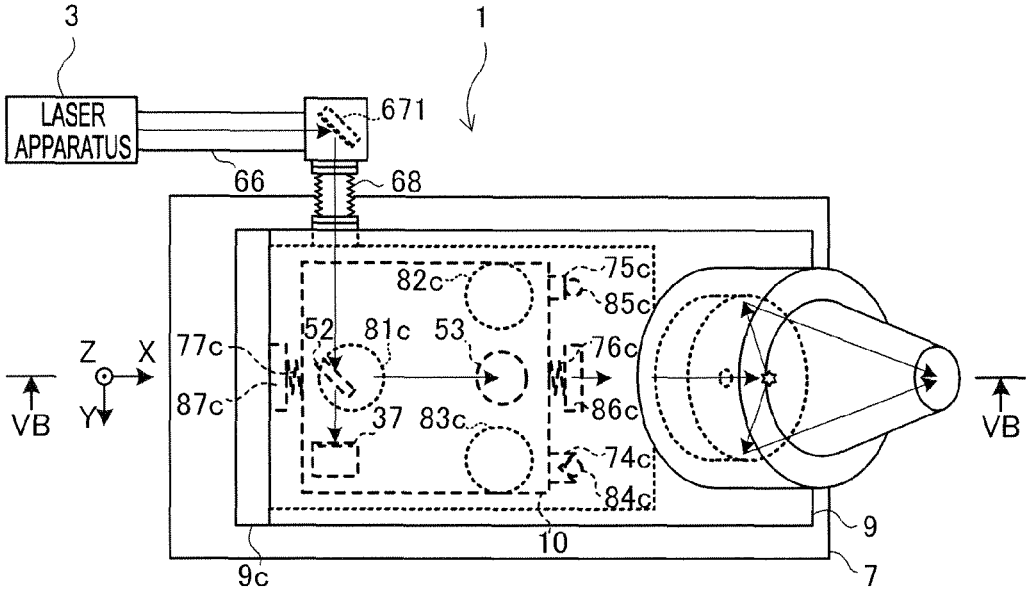
FIG. 5A is a plan view illustrating an exemplary EUV light generation apparatus according to a fourth embodiment of the present disclosure.
Figure 5B:
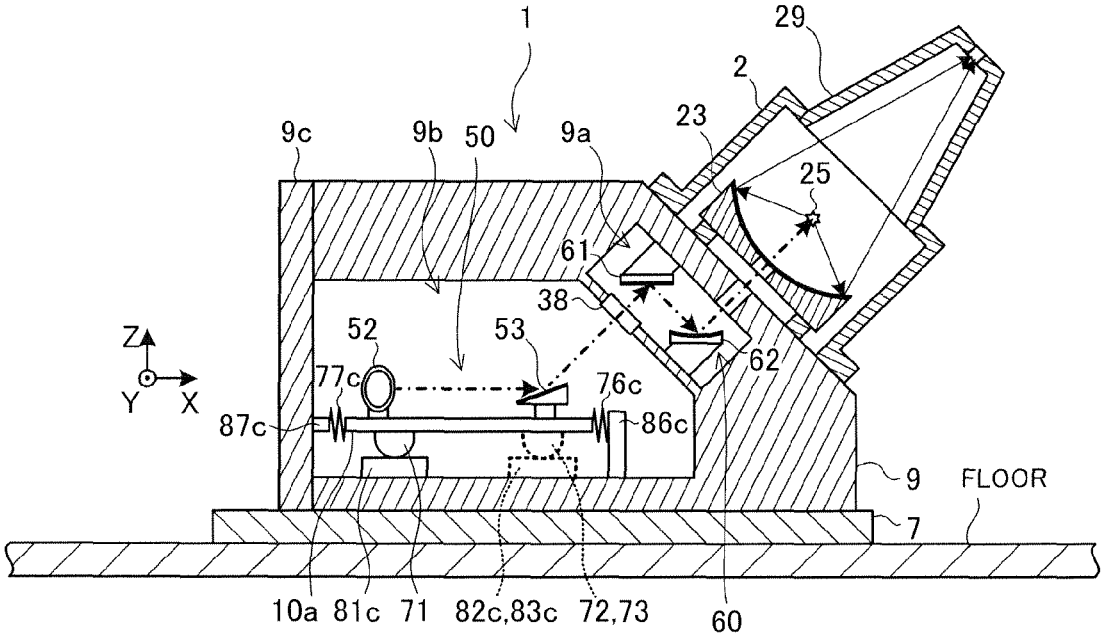
FIG. 5B is a sectional view of the EUV light generation apparatus shown in FIG. 5A, taken along VB-VB plane.

FIG. 5A is a plan view illustrating an EUV light generation apparatus according to a fourth embodiment of the present disclosure. FIG. 5B is a sectional view of the EUV light generation apparatus shown in FIG. 5A, taken along VB-VB plane. In the fourth embodiment, the upper surfaces of mounts 81*c* through 83*c* of the positioning mechanism 10 may be planar.

Biasing members 74*c* and 75*c* may be attached to the support plate 10*a* on a side surface that is parallel to the YZ plane. A V-shaped groove may be formed on a side surface of the biasing member 74*c* in the Z-direction, which corresponds to the direction of gravitational force. A side surface of the biasing member 75*c* may be planar.

The positioning mechanism 10 may include columnar stoppers 84*c* and 85*c*. Each of the stoppers 84*c* and 85*c* may be fixed at one end thereof in the housing chamber 9*b* of the reference member 9 such that the axis of each of the stoppers 84*c* and 85*c* coincides with the direction of gravitational force. The biasing member 75*c* and the stopper 85*c* are not shown in FIG. 5B.

The legs 71 through 73 each having a hemispherical bottom may be placed on the mounts 81*c* through 83*c* each having a planar upper surface, and thus the support plate 10*a* may not easily move in the Z-direction and may not easily rotate about the X-axis or the Y-axis. The biasing member 74*c* having the V-shaped groove may be biased against the stopper 84*c*, and thus the support plate 10*a* may be rotatably supported about the Z-axis. The biasing member 75*c* may be biased against the stopper 85*c*, and thus the support plate 10*a* may be positioned relative to the reference member 9.

An elastic member 76*c* may be attached to the support plate 10*a* at a position between the biasing member 74*c* and the biasing member 75*c*. The elastic member 76*c* may be a spring. When the biasing members 74*c* and 75*c* are biased against the stoppers 84*c* and 85*c*, respectively, the biasing member 76*c* may be biased against a stopper 86*c* fixed inside the housing chamber 9*b* of the reference member 9. Thus, shock that occurs when the biasing members 74*c* and 75*c* are biased against the stoppers 84*c* and 85*c* may be absorbed.

An elastic member 77*c* may be attached to the support plate 10*a* at a position opposite from the elastic member 76*c*. The elastic member 77*c* may be a spring. When the housing chamber 9*b* is closed by the lid 9*c*, a pressing member 87*c* may bias the elastic member 77*c*. Thus, when the housing chamber 9*b* is closed by the lid 9*c*, the biasing members 74*c* and 75*c* may be biased against the stoppers 84*c* and 85*c*, respectively. Accordingly, the laser beam introduction optical system 50 supported by the support plate 10*a* may be positioned relative to the reference member 9.

5. EXAMPLES OF OPTICAL ELEMENTS

5.1 Fifth Embodiment

Figure 6A:
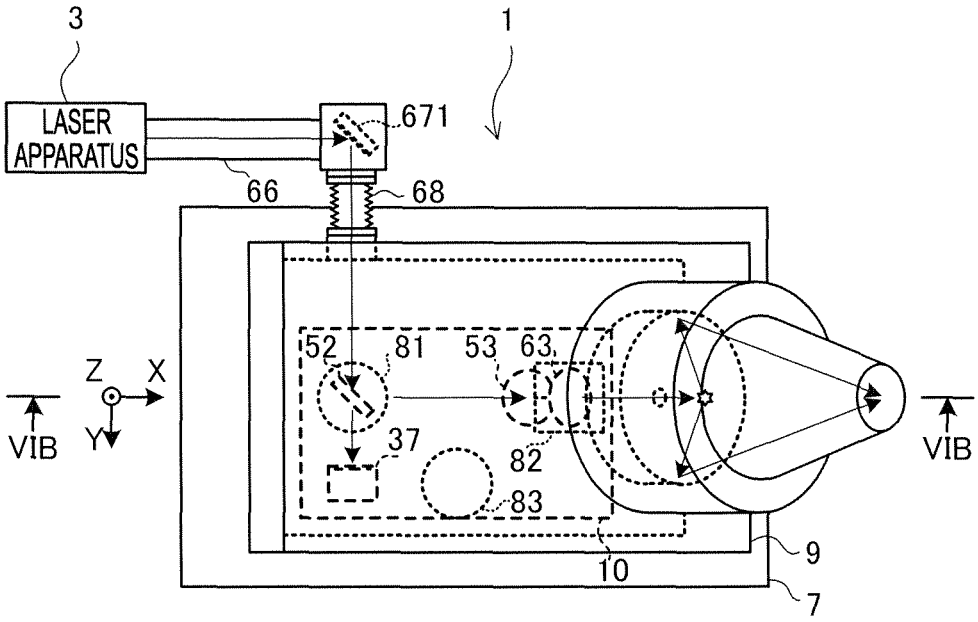
FIG. 6A is a plan view illustrating an exemplary EUV light generation apparatus according to a fifth embodiment of the present disclosure.
Figure 6B:
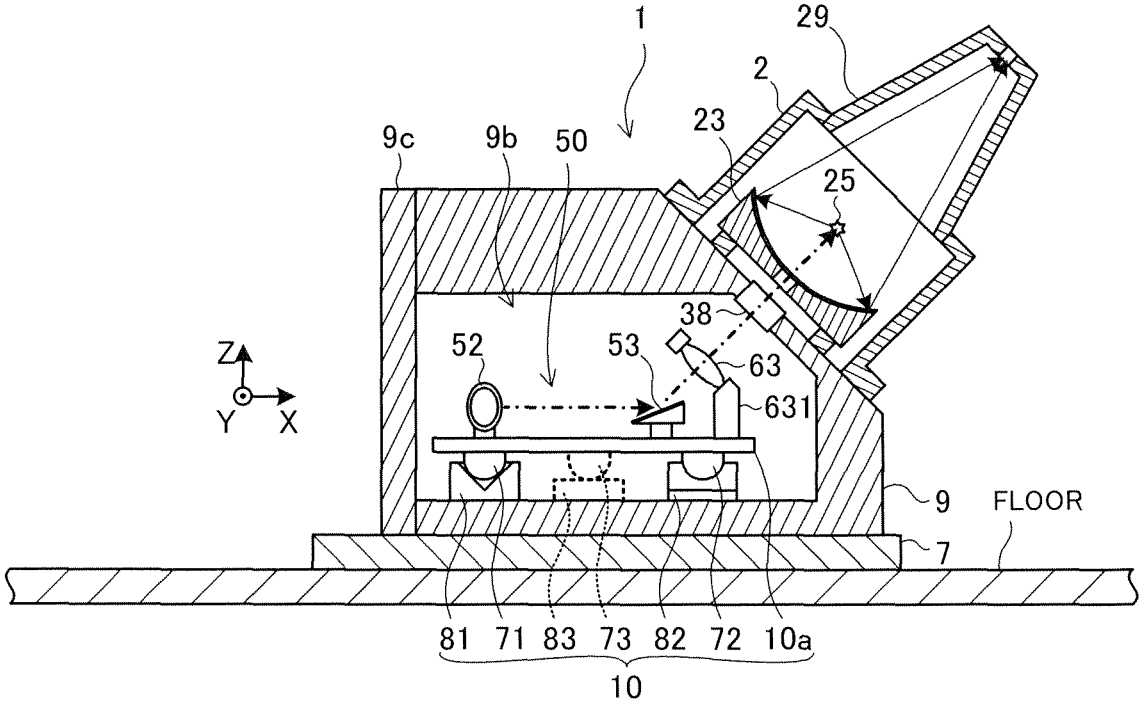
FIG. 6B is a sectional view of the EUV light generation apparatus shown in FIG. 6A, taken along VIB-VIB plane.

FIG. 6A is a plan view illustrating an EUV light generation apparatus according to a fifth embodiment of the present disclosure. FIG. 6B is a sectional view of the EUV light generation apparatus shown in FIG. 6A, taken along VIB-VIB plane.

The housing chamber 9*a* (see FIGS. 2B, 3B, 4B, and 5B) that is in communication with the chamber 2 may not be provided in the reference member 9, and only the housing chamber 9*b* may be provided in the reference member 9. The window 38 may be provided in the reference member 9 to provide an airtight seal between the housing chamber 9*b* and the chamber 2 while allowing a laser beam to enter the chamber 2.

A laser beam focusing optical system 63 may be supported by the support plate 10*a* of the positioning mechanism 10 in the housing chamber 9*b* through a holder 631. The laser beam focusing optical system 63 may include at least one mirror, at least one lens, or a combination thereof. The arrangement of the legs 71 through 73 and the mounts 81 through 83 for supporting the support plate 10*a* may be the same as that in the second embodiment.

In the fifth embodiment, the laser beam introduction optical system 50 that includes the beam splitter 52 and the high-reflection mirror 53 and the laser beam focusing optical system 63 may altogether be positioned to the reference member 9 through the positioning mechanism 10. Thus, the laser beam focusing optical system 63 and the laser beam introduction optical system 50 may be positioned with precision relative to the plasma generation region 25. Accordingly, a target may be irradiated with the laser beam with high precision, and an output of EUV light may be stabilized.

5.2 Sixth Embodiment

Figure 7A:
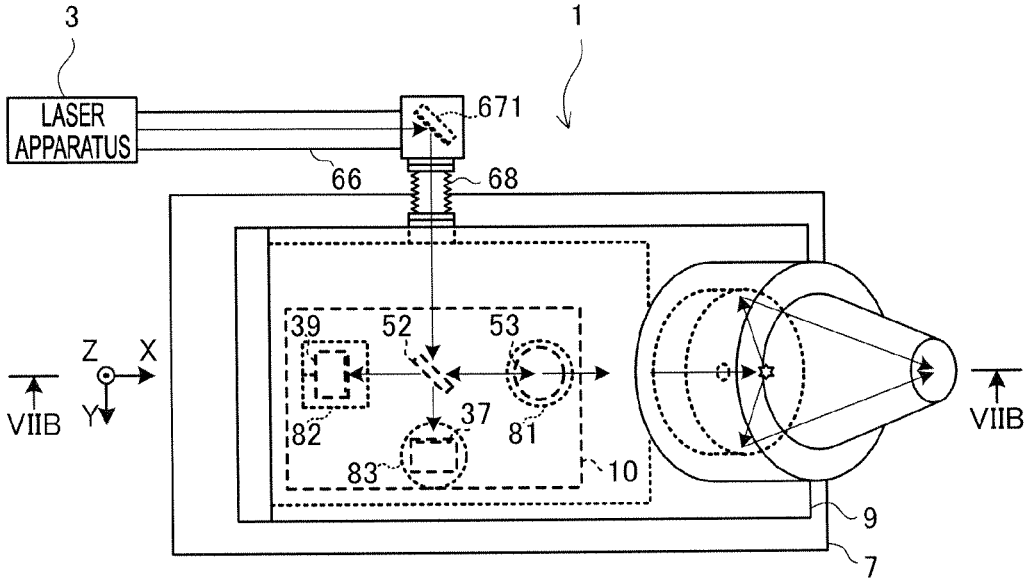
FIG. 7A is a plan view illustrating an exemplary EUV light generation apparatus according to a sixth embodiment of the present disclosure.
Figure 7B:
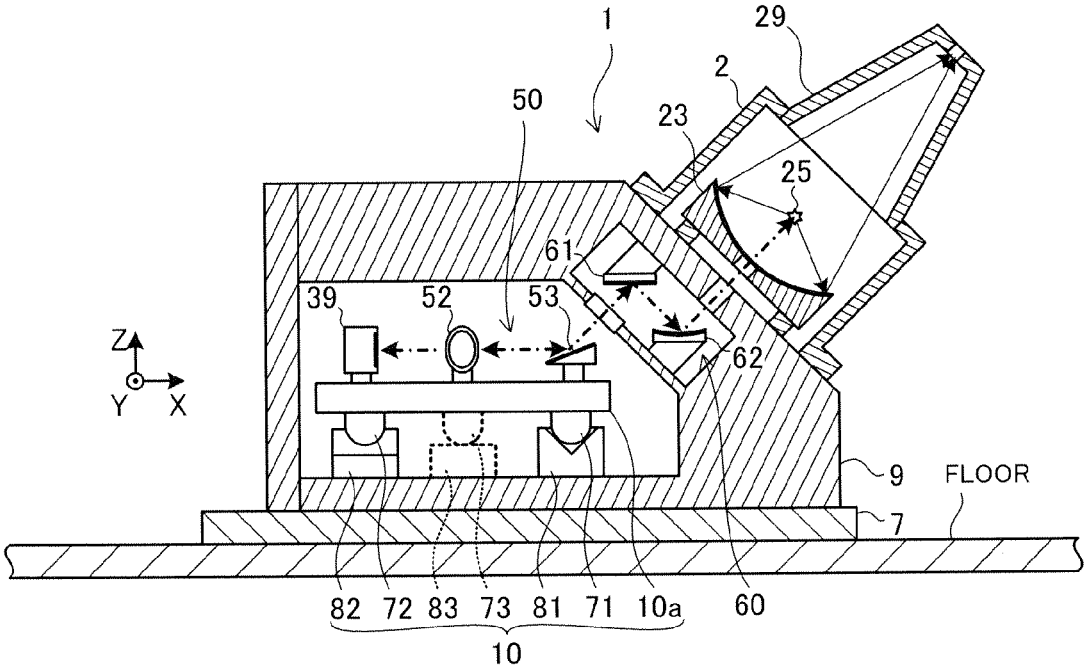
FIG. 7B is a sectional view of the EUV light generation apparatus shown in FIG. 7A, taken along VIIB-VIIB plane.

FIG. 7A is a plan view illustrating an EUV light generation apparatus according to a sixth embodiment of the present disclosure. FIG. 7B is a sectional view of the EUV light generation apparatus shown in FIG. 7A, taken along VIIB-VIIB plane.

In the sixth embodiment, a backpropagating beam measuring unit 39 may be supported on the upper surface of the support plate 10*a* of the positioning mechanism 10 through a holder. The backpropagating beam measuring unit 39 may be positioned such that a backpropagating beam from the plasma generation region 25 is incident on the photosensitive surface thereof through the high-reflection mirror 53 and the beam splitter 52. The backpropagating beam from the plasma generation region 25 may include a part of a laser beam reflected by a target. An imaging optical system (not separately shown) may be provided between the beam splitter 52 and the backpropagating beam measuring unit 39 to form an image of a target irradiated with the laser beam on the photosensitive surface of the backpropagating beam measuring unit 39. Measuring the backpropagating beam with the backpropagating beam measuring unit 39 may enable to determine whether or not a target has been irradiated with a laser beam at its focus.

The leg 71 may be provided at a position immediately underneath the high-reflection mirror 53. The leg 72 may be provided at a position immediately underneath the backpropagating beam measuring unit 39. In the sixth embodiment, the laser beam introduction optical system 50 that includes the beam splitter 52 and the high-reflection mirror 53 and the backpropagating beam measuring unit 39 may altogether be fixed to the reference member 9 and positioned relative to each other through the positioning mechanism 10 so that the positional relationship among the beam splitter 52, the high-reflection mirror 53, and the backpropagating beam measuring unit 39 does not vary. Accordingly, the backpropagating beam from the plasma generation region 25 may stably be measured with the back propagating beam measuring unit 39.

6. EXAMPLES OF MOVING MECHANISM

6.1 Seventh Embodiment

Figure 8A:
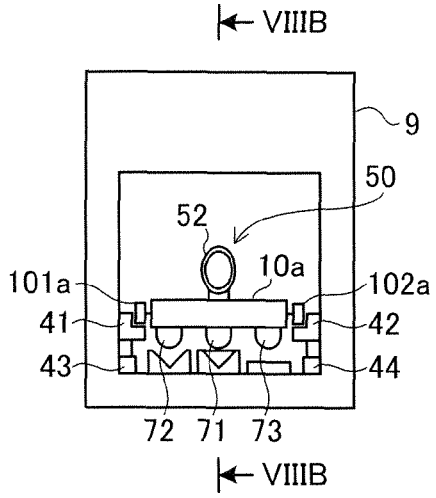
FIG. 8A is a front view illustrating the interior of a reference member of an exemplary EUV light generation apparatus according to a seventh embodiment of the present disclosure.
Figure 8B:
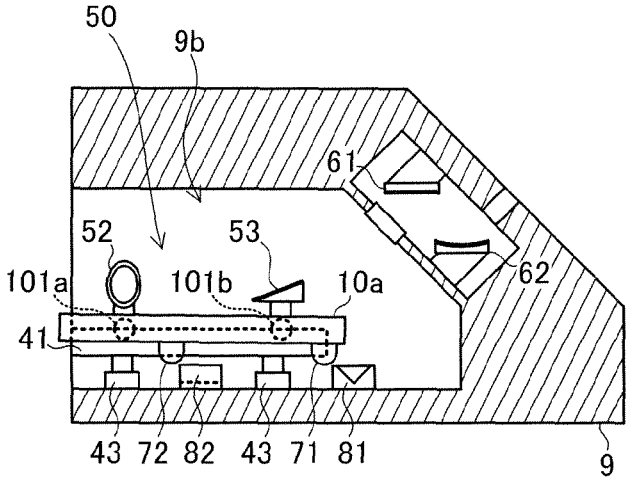
FIG. 8B is a sectional view of the reference member shown in FIG. 8A, taken along VIIIB-VIIIB plane.
Figure 8C:
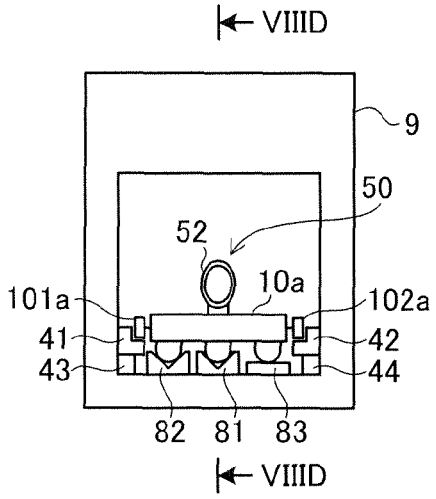
FIG. 8C is a front view illustrating the interior of the reference member shown in FIG. 8A in a state where a laser beam introduction optical system is positioned to the reference member.
Figure 8D:
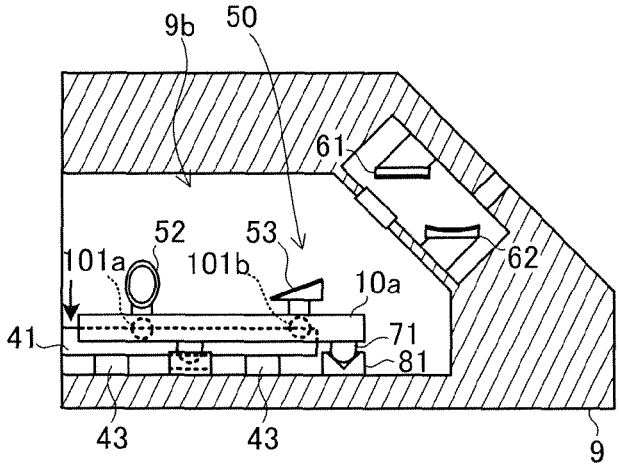
FIG. 8D is a sectional view of the reference member shown in FIG. 8C, taken along VIIID-VIIID plane.

FIG. 8A is a front view illustrating the interior of a reference member of an EUV light generation apparatus according to a seventh embodiment of the present disclosure. FIG. 8B is a sectional view of the reference member shown in FIG. 8A, taken along VIIIB plane. FIG. 8C is a front view illustrating the interior of the reference member shown in FIG. 8A in a state where a laser beam introduction optical system 50 is positioned to the reference member. FIG. 8D is a sectional view of the reference member shown in FIG. 8C, taken along VIIID-VIIID plane.

As shown in FIGS. 8A through 8D, a moving mechanism that includes a pair of rails 41 and 42 and driving mechanisms 43 and 44 may be provided in the housing chamber 9*b* of the reference member 9. The rails 41 and 42 may be arranged parallel to each other and at the same height. The driving mechanisms 43 and 44 may be configured to move the rails 41 and 42 vertically at the same rate. Wheels 101*a* and 101*b* may be provided on the support plate 10*a* to be movable along the rail 41, and a wheel 102 and another wheel (not separately shown) may be provided on the support plate 10*a* to be movable along the rail 42.

The legs 71 through 73 may be attached on the lower surface of the support plate 10*a*. The mounts 81 through 83, on which the legs 71 through 73 are placed, respectively, may be fixed inside the housing chamber 9*b* of the reference member 9. A conical recess may be formed on the upper surface of the mount 81. A V-shaped groove may be formed on the upper surface of the mount 82. The upper surface of the mount 83 may be planar.

Moving the wheels 101*a*, 101*b*, and 102*a* along the rails 41 and 42 may allow the support plate 10*a* to move. When the leg 71 of the support plate 10*a* reaches above the mount 81, the driving mechanisms 43 and 44 may lower the rails 41 and 42, respectively (see FIGS. 8C and 8D). Thus, the legs 71 through 73 may be placed on the mounts 81 through 83, respectively, and the laser beam introduction optical system 50 that includes the beam splitter 52 and the high-reflection mirror 53 may be positioned to the reference member 9. Thereafter, the housing chamber 9*b* may be closed by the lid 9*c* (see FIG. 3B).

When the laser beam introduction optical system 50 is replaced or maintenance work is carried out on the laser beam introduction optical system 50, the driving mechanisms 43 and 44 may raise the rails 41 and 42, respectively. Thereafter, by moving the support plate 10*a* along the rails 41 and 42, the laser beam introduction optical system 50 that includes the beam splitter 52 and the high-reflection mirror 53 may be removed from the housing chamber 9*b*.

According to the seventh embodiment, a work load for positioning the laser beam introduction optical system 50 to the reference member 9 and a work load for removing the laser beam introduction optical system 50 from the chamber 9 may be reduced.

6.2 Eighth Embodiment

Figure 9A:
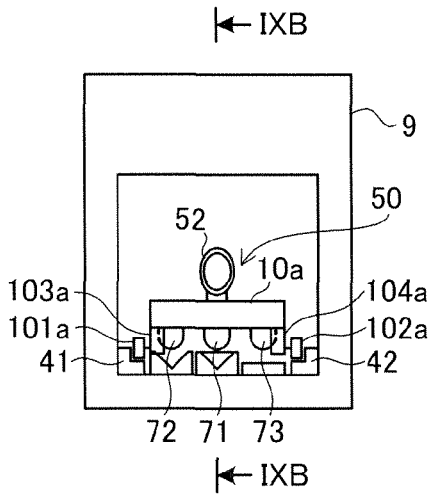
FIG. 9A is a front view illustrating the interior of a reference member of an exemplary EUV light generation apparatus according to an eighth embodiment of the present disclosure.
Figure 9B:
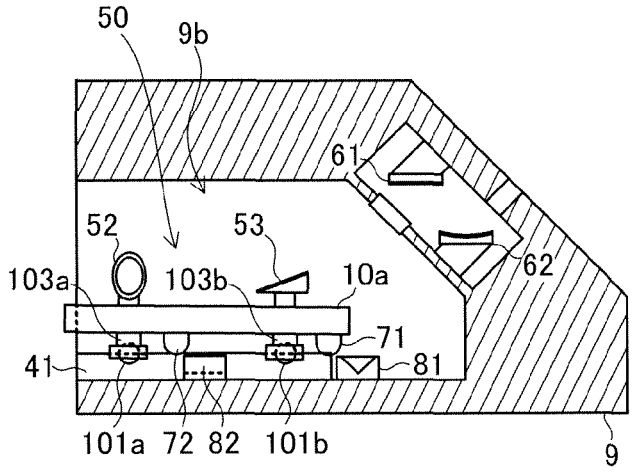
FIG. 9B is a sectional view of the reference member shown in FIG. 9A, taken along IXB-IXB plane.
Figure 9C:
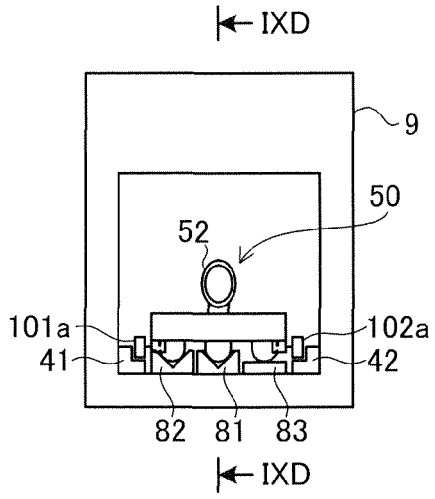
FIG. 9C is a front view illustrating the interior of the reference member shown in FIG. 9A in a state where a laser beam introduction optical system is positioned to the reference member.
Figure 9D:
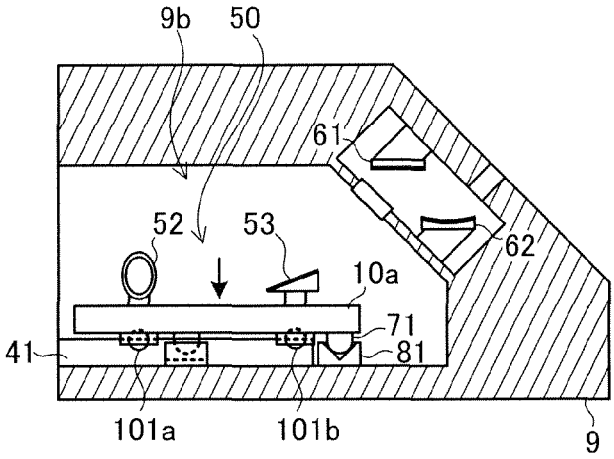
FIG. 9D is a sectional view of the interior of the reference member shown in FIG. 9C, taken along IXD-IXD plane.

FIG. 9A is a front view illustrating the interior of a reference member of an EUV light generation apparatus according to an eighth embodiment of the present disclosure. FIG. 9B is a sectional view of the reference member shown in FIG. 9A, taken along IXB-IXB plane. FIG. 9C is a front view illustrating the interior of the reference member shown in FIG. 9A in a state where a laser beam introduction optical system 50 is positioned to the reference member. FIG. 9D is a sectional view of the reference member shown in FIG. 9C, taken along IXD-IXD plane.

In the eighth embodiment, the support plate 10*a* may be moved vertically relative to the wheels 101*a*, 101*b*, and 102*a*. The rails 41 and 42 may be fixed to the bottom of the housing chamber 9*b* to be parallel to each other. Driving mechanisms 103*a*, 103*b*, and 104*a*, and another driving mechanism (not separately shown) may be provided to the support plate 10*a* to move the support plate 10*a* vertically with respect to the wheels 101*a*, 101*b*, 102*a*, and another wheel (not separately shown), respectively.

Moving the wheels 101*a*, 101*b*, and 102*a* along the rails 41 and 42 may allow the support plate 10*a* to move. When the leg 71 of the support plate 10*a* reaches above the mount 81, the driving mechanisms 103*a*, 103*b*, and 104*a* may lower the support plate 10*a* (see FIGS. 9C and 9D). Thus, the support plate 10*a* may be lowered, and the legs 71 through 73 may be placed on the mounts 81 through 83, respectively. Accordingly, the laser beam introduction optical system 50 that includes the beam splitter 52 and the high-reflection mirror 53 may be positioned to the reference member 9. Thereafter, the housing chamber 9*b* may be closed by the lid 9*c* (see FIG. 3B). At this point, the wheels 101*a*, 101*b*, and 102*a* may not need to be in contact with the rails 41 and 42.

When the laser beam introduction optical system 50 is replaced or maintenance work is carried out on the laser beam introduction optical system 50, the driving mechanisms 103*a*, 103*b*, and 104*a* may raise the support plate 10*a*. Thereafter, by moving the support plate 10*a* along the rails 41 and 42, the laser beam introduction optical system 50 that includes the beam splitter 52 and the high-reflection mirror 53 may be removed from the housing chamber 9*b*.

6.3 Ninth Embodiment

Figure 10A:
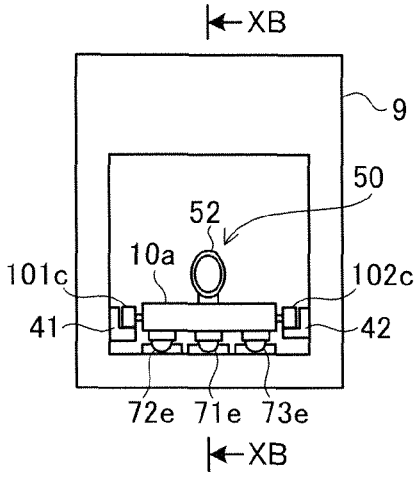
FIG. 10A is a front view illustrating the interior of a reference member of an exemplary EUV light generation apparatus according to a ninth embodiment of the present disclosure.
Figure 10B:
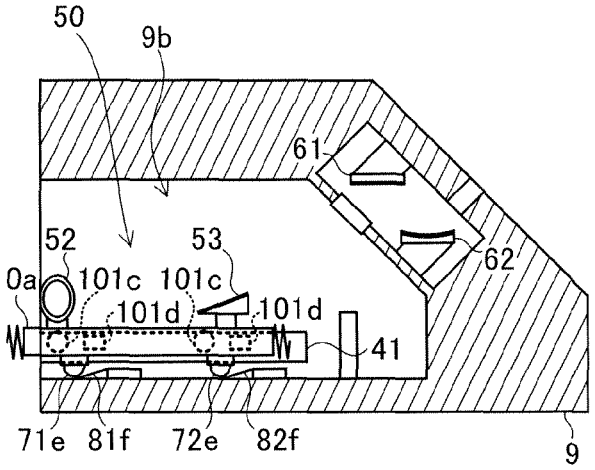
FIG. 10B is a sectional view of the reference member shown in FIG. 10A, taken along XB-XB plane.
Figure 10C:
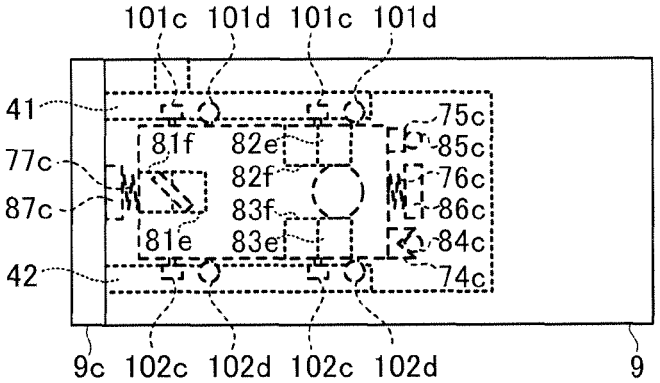
FIG. 10C is a plan view illustrating the reference member shown in FIG. 10A in a state where a laser beam introduction optical system is positioned to the reference member.
Figure 10D:
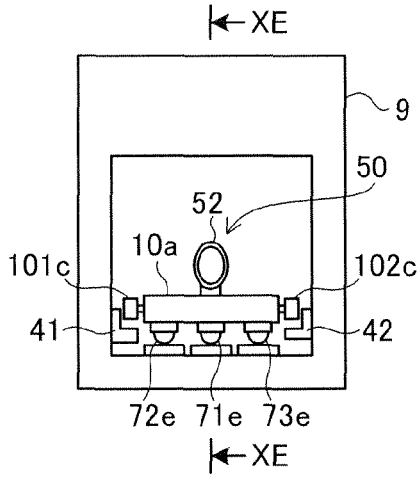
FIG. 10D is a front view illustrating the interior of the reference member shown in FIG. 10C.
Figure 10E:
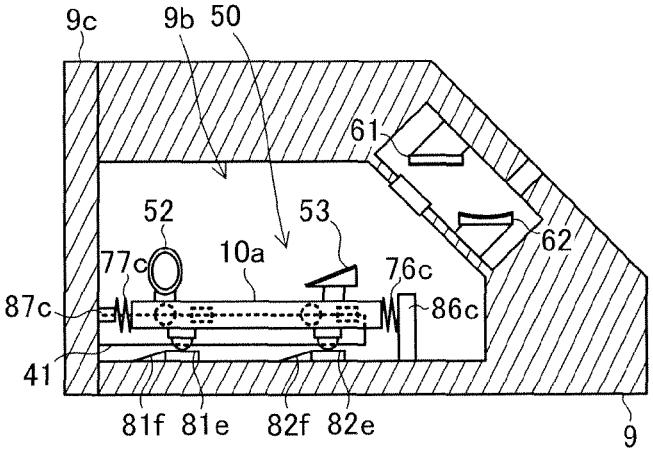
FIG. 10E is a sectional view of the reference member shown in FIG. 10D, taken along XE-XE plane.

FIG. 10A is a front view illustrating the interior of a reference member of an EUV light generation apparatus according to a ninth embodiment of the present disclosure. FIG. 10B is a sectional view of the reference member shown in FIG. 10A, taken along XB-XB plane. FIG. 10C is a plan view illustrating the reference member shown in FIG. 10A in a state where a laser beam introduction optical system 50 is positioned to the reference member. FIG. 10D is a front view of the interior of the reference member shown in FIG. 10C. FIG. 10E is a sectional view of the reference member shown in FIG. 10D, taken along XE-XE plane.

As shown in FIGS. 10A through 10E, a moving mechanism that includes the pair of rails 41 and 42 may be provided in the housing chamber 9*b* of the reference member 9. The rails 41 and 42 may be arranged parallel to each other and at the same height. Wheels 101*c* and 101*d* may be provided to the support plate 10*a* to be movable along the rail 41, and wheels 102*c* and 102*d* may be provided to the support plate 10*a* to be movable along the rail 42. As the wheels 101*c*, 101*d*, 102*c*, and 102*d* may move on the rails 41 and 42, the support plate 10*a* may be moved.

Legs 71*e* through 73*e* may be attached on the lower surface of the support plate 10*a*. A ball bearing (not separately shown) may be provided at the lower end of each of the legs 71*e* through 73*e*. Slopes 81*f* through 83*f* may be provided adjacent to mounts 81*e* through 83*e* having planar upper surfaces.

When the support plate 10*a* is moved to the right in FIG. 10B, the legs 71*e* through 73*e* may come into contact with the slopes 81*f* through 83*f*, respectively. As the support plate 10*a* is further moved, the legs 71*e* through 73*e* may run on the slopes 81*f* through 83*f*, respectively. Then, the wheels 101*c* and 102*c* may be distanced from the rails 41 and 42. Meanwhile, the wheels 101*d* and 102*d* may move while being in contact with the side surfaces of the rails 41 and 42, respectively. When the support plate 10*a* is moved even further, the legs 71*e* through 73*e* may move along the slopes 81*f* through 83*f* to reach the planar upper surfaces of the respective mounts 81*e* through 83*e*. Then, as in the fourth embodiment, the biasing members 74*c* and 75*c* may be biased against the stoppers 84*c* and 85*c*, respectively, and thus the laser beam introduction optical system 50 that includes the beam splitter 52 and the high-reflection mirror 53 may be positioned to the reference member 9. Here, since the laser beam introduction optical system 50 is positioned by biasing the biasing members 74*c* and 75*c* against the stoppers 84*c* and 85*c*, the wheels 101*d* and 102*d* may not need to be in contact with the side surfaces of the rails 41 and 42, respectively.

6.4 Tenth Embodiment

Figure 11A:
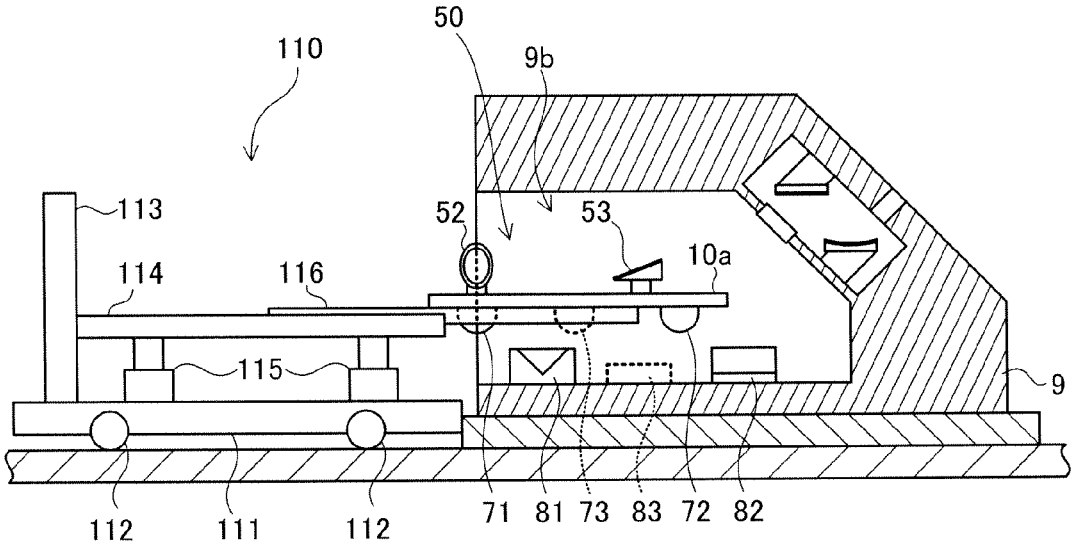
FIG. 11A is a partial sectional view illustrating a reference member and a moving mechanism of an exemplary EUV light generation apparatus according to a tenth embodiment of the present disclosure.
Figure 11B:
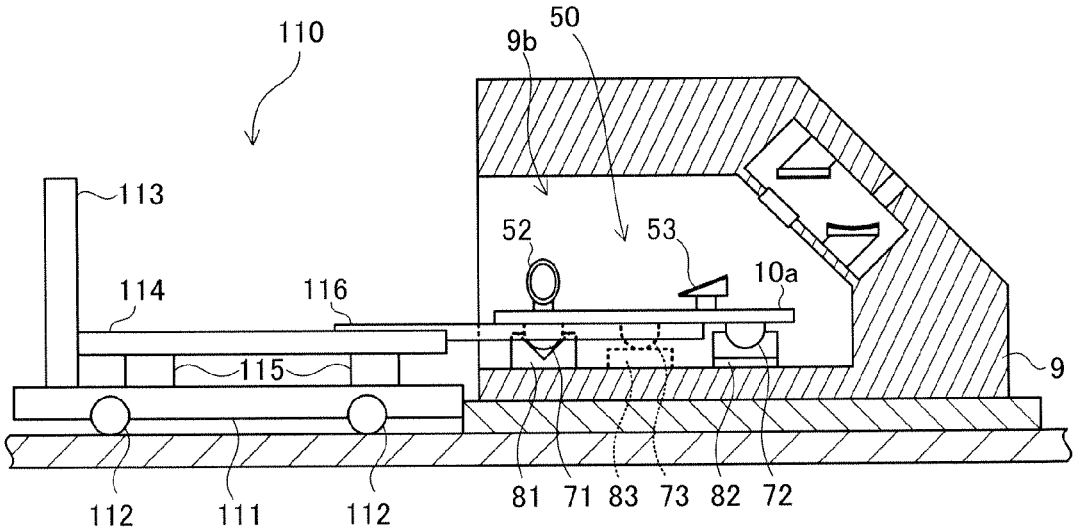
FIG. 11B is a partial sectional view illustrating the reference member shown in FIG. 11A in a state where a laser beam introduction optical system is positioned to the reference member.

FIG. 11A is a partial sectional view illustrating a reference member and a moving mechanism of an EUV light generation apparatus according to a tenth embodiment of the present disclosure. FIG. 11B is a partial sectional view illustrating the reference member shown in FIG. 11A in a state where a laser beam introduction optical system 50 is positioned to the reference member.

As shown in FIGS. 11A and 11B, the moving mechanism may include a dolly 110. The dolly 110 may include a frame 111, wheels 112, a stay 113, a rail 114, drive units 115, and a support 116.

The dolly 110 may be moved as the wheels 112 roll on the floor. The stay 113 may be fixed to the frame 111 to stand vertically with respect to the floor surface. The drive units 115 may move the rail 114 vertically with respect to the frame 111. Directions in which the rail 114 is movable may be regulated by the stay 113. The rail 114 may be provided to be horizontal with respect to the floor surface and vertically movable with respect to the frame 111. The support 116 may be movable along the rail 114. The support 116 may hold the support plate 10*a* thereon.

The support 116 holding the support plate 10*a* may move along the rail 114 to move the support plate 10*a*. When the support plate 10*a* moves along the rail 114 and the legs 71 through 73 reach above the respective mounts 81 through 83, the drive units 115 may lower the rail 114 (see FIG. 11B). Thus, the legs 71 through 73 may be placed on the mounts 81 through 83, respectively, and the laser beam introduction optical system 50 that includes the beam splitter 52 and the high-reflection mirror 53 may be positioned to the reference member 9. Thereafter, the drive units 115 may further lower the rail 114. Then, the support plate 10*a* may be separated from the support 116 to allow the dolly 110 to be removed.

When the laser beam introduction optical system 50 is replaced or maintenance work is carried out on the laser beam introduction optical system 50, the dolly 110 may be arranged at the position shown in FIG. 11B, and the drive units 115 may raise the rail 114. Thereafter, by moving the support 116 holding the support plate 10*a* along the rail 114, the laser beam introduction optical system 50 that includes the beam splitter 52 and the high-reflection mirror 53 may be removed from the housing chamber 9*b*.

According to the tenth embodiment, a work load for positioning the laser beam introduction optical system 50 to the reference member 9 and a work load for removing the laser beam introduction optical system 50 from the reference member 9 may be reduced.

6.5 Eleventh Embodiment

Figure 12A:
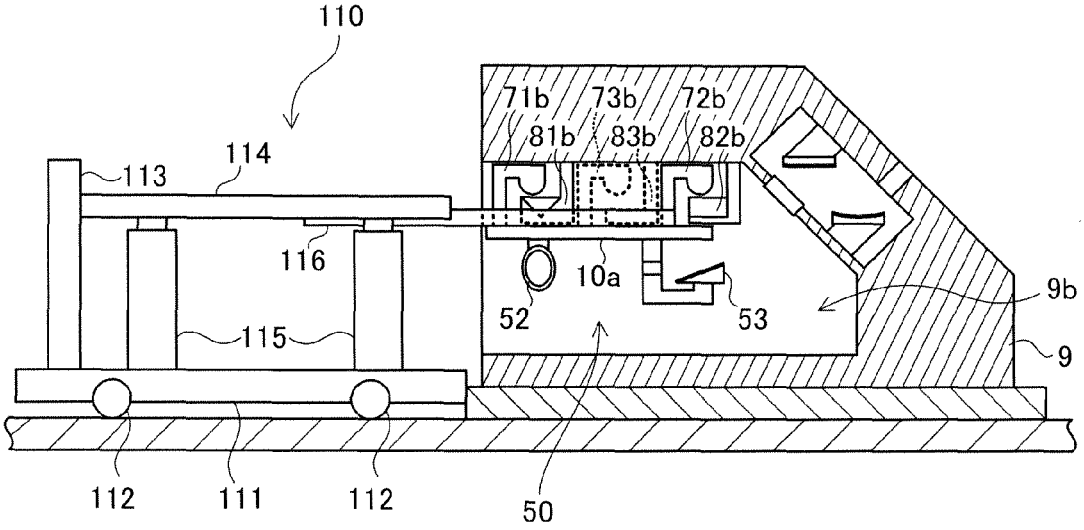
FIG. 12A is a partial sectional view illustrating a reference member and a moving mechanism of an exemplary EUV light generation apparatus according to an eleventh embodiment of the present disclosure.
Figure 12B:
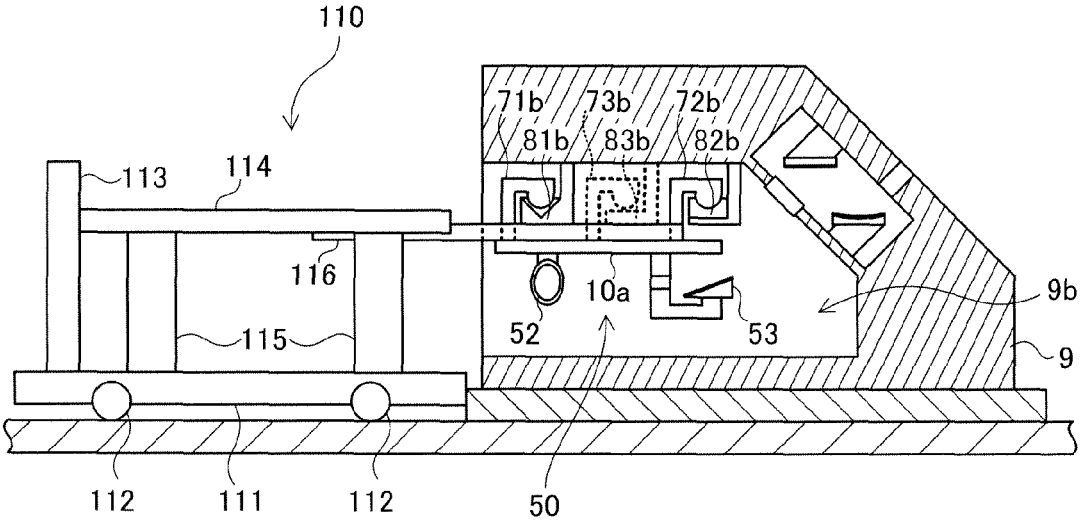
FIG. 12B is a partial sectional view illustrating the reference member shown in FIG. 12A in a state where a laser beam introduction optical system is positioned to the reference member.

FIG. 12A is a partial sectional view illustrating a reference member and a moving mechanism of an EUV light generation apparatus according to an eleventh embodiment of the present disclosure. FIG. 12B is a partial sectional view illustrating the reference member shown in FIG. 12A in a state where a laser beam introduction optical system 50 is positioned to the reference member.

As shown in FIGS. 12A and 12B, the moving mechanism may include the dolly 110. The configuration of the dolly 110 may be similar to that in the tenth embodiment. According to the eleventh embodiment, a work load for positioning the laser beam introduction optical system 50 to the reference member 9 and a work load for removing the laser beam introduction optical system 50 from the reference member 9 may be reduced.

7. EUV LIGHT GENERATION SYSTEM INCLUDING PRE-PULSE LASER APPARATUS: TWELFTH EMBODIMENT

7.1 Configuration and Operation

Figure 13A:
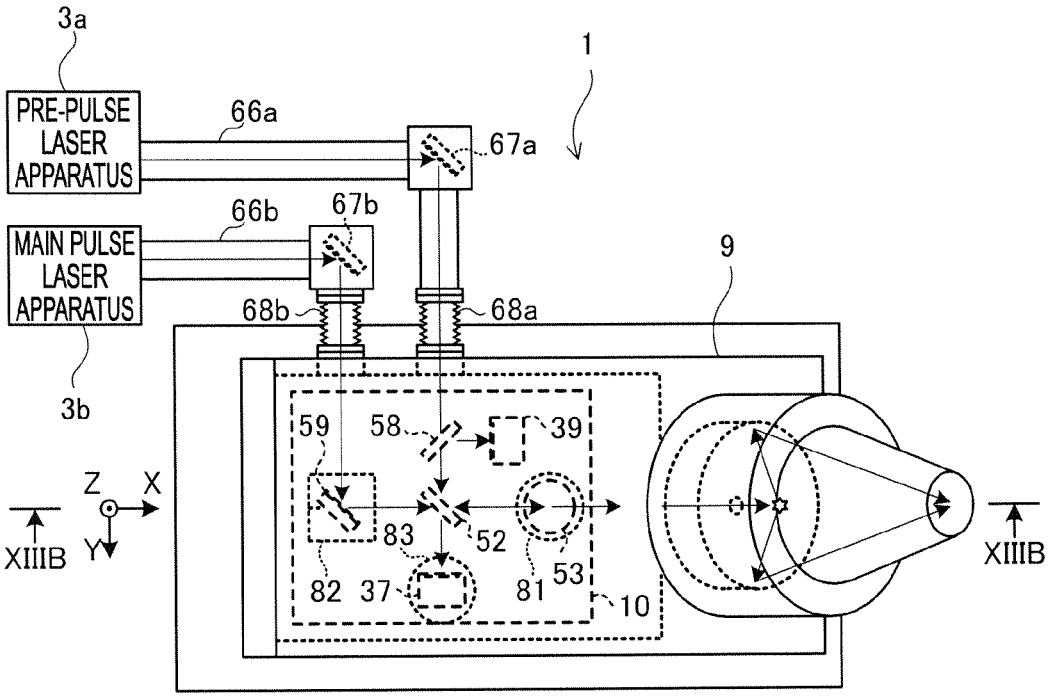
FIG. 13A is a plan view illustrating an exemplary EUV light generation apparatus according to a twelfth embodiment of the present disclosure.
Figure 13B:
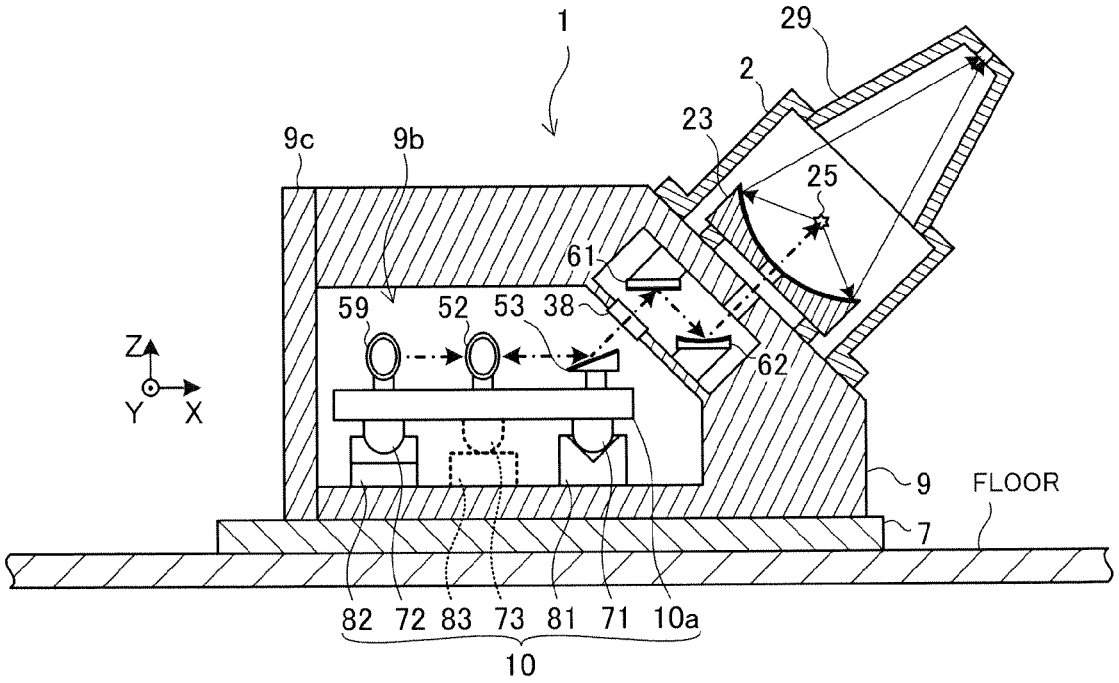
FIG. 13B is a sectional view of the EUV light generation apparatus shown in FIG. 13A, taken along XIIIB-XIIIB plane.

FIG. 13A is a plan view illustrating an EUV light generation apparatus according to a twelfth embodiment of the present disclosure. FIG. 13B is a sectional view of the EUV light generation apparatus shown in FIG. 13A, taken along XIIIB-XIIIB plane.

In the twelfth embodiment, a target may be irradiated with a pre-pulse laser beam to be diffused, and the diffused target may then be irradiated with a main pulse laser beam to be turned into plasma. For example, a yttrium aluminum garnet (YAG) laser apparatus that oscillates at a wavelength of 1.06 μm may be used as a pre-pulse laser apparatus, and a carbon-dioxide ($CO_2$) laser apparatus that oscillates at a wavelength of 10.6 μm may be used as a main pulse laser apparatus.

As shown in FIG. 13A, a pre-pulse laser apparatus 3*a* and a main pulse laser apparatus 3*b* may be provided to output a pre-pulse laser beam and a main pulse laser beam, respectively.

Optical pipes 66*a* and 66*b* may be attached to the reference member 9 through flexible pipes 68*a* and 68*b*, respectively. High-reflection mirrors 67*a* and 67*b* may be provided in the optical pipes 66*a* and 66*b*, respectively. The optical pipes 66*a* and 66*b* may be connected to the laser apparatuses 3*a* and 3*b*, respectively.

A beam splitter 58, a high-reflection mirror 59, the beam splitter 52, the high-reflection mirror 53, the laser beam measuring unit 37, and the backpropagating beam measuring unit 39 may be supported on the upper surface of the support plate 10*a* of the positioning mechanism 10 through respective holders. The leg 71 to be placed on the mount 81 having a conical recess may be provided at a position immediately underneath the high-reflection mirror 53. The leg 72 to be placed on the mount 82 having a V-shaped groove may be provided at a position immediately underneath the high-reflection mirror 59.

The beam splitter 58 may transmit the pre-pulse laser beam with high transmittance. The high-reflection mirror 59 may reflect the main pulse laser beam with high reflectance. The pre-pulse laser beam transmitted through the beam splitter 58 may be incident on a first surface of the beam splitter 52. The main pulse laser beam reflected by the high-reflection mirror 59 may be incident on a second surface of the beam splitter 52.

The beam splitter 52 may reflect the pre-pulse laser beam incident on the first surface thereof toward the high-reflection mirror 53 with high reflectance. The beam splitter 52 may transmit a part of the pre-pulse laser beam incident on the first surface thereof toward the laser beam measuring unit 37.

Further, the beam splitter 52 may transmit the main pulse laser beam incident on the second surface thereof toward the high-reflection mirror 53 with high transmittance. The beam splitter 52 may reflect a part of the main pulse laser beam incident on the second surface thereof toward the laser beam measuring unit 37.

The laser beam measuring unit 37 may have a photosensitive surface sensitive to both the wavelength of the pre-pulse laser beam and the wavelength of the main pulse laser beam.

The beam splitter 52 may serve as a beam combiner for controlling the direction in which the pre-pulse laser beam travels and the direction in which the main pulse laser beam travels to coincide with each other. The beam splitter 52 may, for example, be formed of diamond.

The high-reflection mirror 53 may reflect the pre-pulse laser beam reflected by the beam splitter 52 and the main pulse laser beam transmitted through the beam splitter 52 with high reflectance.

The pre-pulse laser apparatus 3*a* and the main pulse laser apparatus 3*b* may be controlled so that the main pulse laser beam is outputted when a predetermined time elapses after the pre-pulse laser beam is outputted. The pre-pulse laser beam and the main pulse laser beam sequentially reflected by the high-reflection mirror 53 may be transmitted through the window 38 with high transmittance, and reflected by the high-reflection mirror 61 with high reflectance. Then, the pre-pulse laser beam and the main pulse laser beam may be focused on a target and a diffused target, respectively, in the plasma generation region 25 by the laser beam focusing mirror 62.

A backpropagating beam from the plasma generation region 25 may be incident on the photosensitive surface of the backpropagating beam measuring unit 39 through the high-reflection mirror 53, the beam splitter 52, and the beam splitter 58. An imaging optical system (not separately shown) may be provided between the beam splitter 58 and the backpropagating beam measuring unit 39 to form an image of a target irradiated with the pre-pulse laser beam on the photosensitive surface of the backpropagating beam measuring unit 39. Measuring the backpropagating beam with the backpropagating beam measuring unit 39 may enable to determine whether or not a target has been irradiated with the pre-pulse laser beam at its focus.

According to the twelfth embodiment, even in a case where a target is irradiated with a pre-pulse laser beam and a diffused target is then irradiated with a main pulse laser beam, the target and the diffused target may be irradiated respectively with the pre-pulse laser beam and the main pulse laser beam with high precision.

7.2 Details of Laser Beam Measuring Unit

Figure 14:
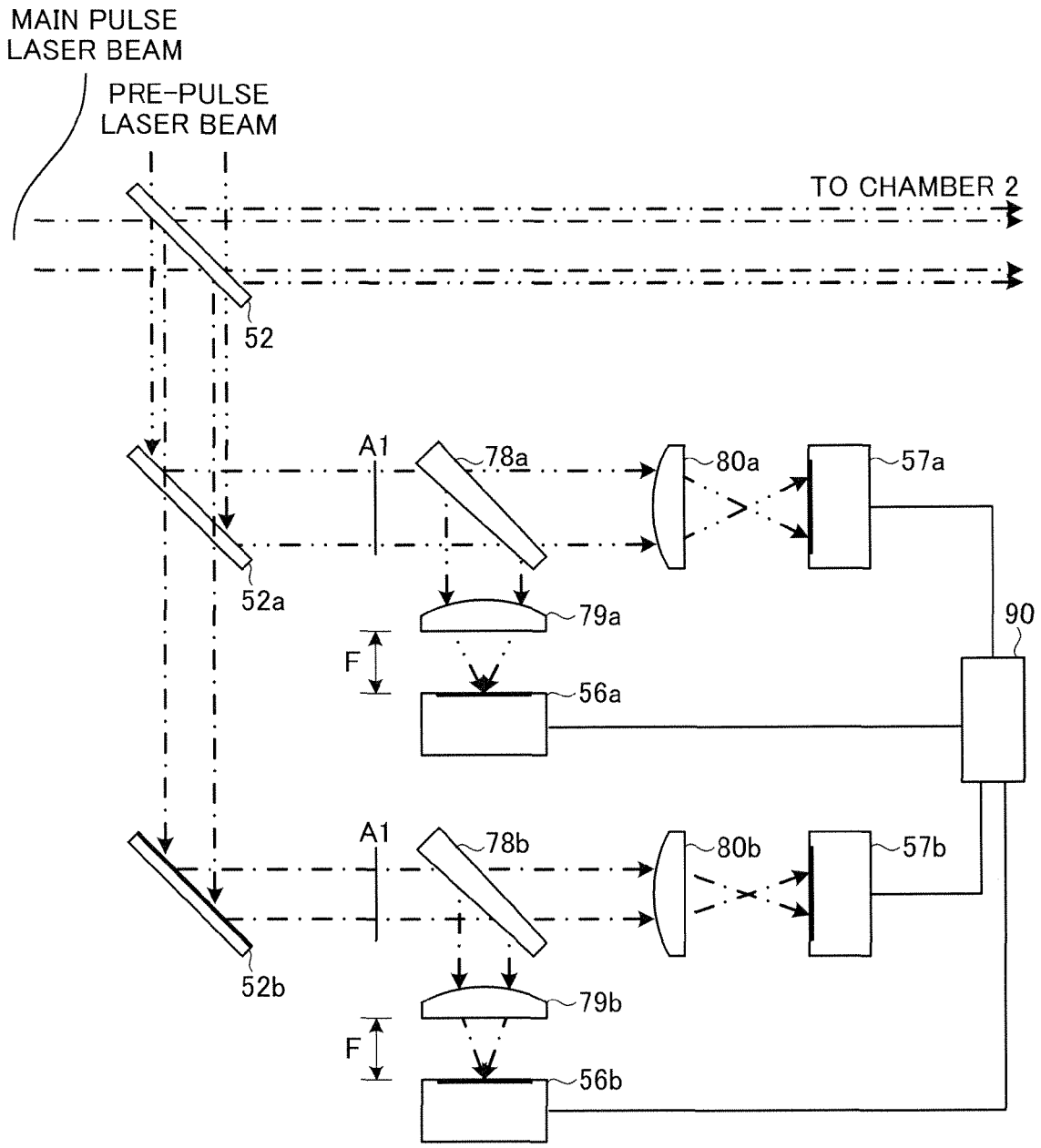
FIG. 14 illustrates an exemplary configuration of a laser beam measuring unit of the twelfth embodiment.

FIG. 14 illustrates an exemplary configuration of a laser beam measuring unit of the twelfth embodiment. The beam splitter 52 may be positioned such that a pre-pulse laser beam is incident on the first surface thereof and a main pulse laser beam is incident on the second surface thereof. The pre-pulse laser beam may be reflected by the first surface of the beam splitter 52, and the main pulse laser beam may be transmitted through the beam splitter 52. The pre-pulse laser beam reflected by the beam splitter 52 and the main pulse laser beam transmitted through the beam splitter 52 may be guided into the chamber 2. Meanwhile, a part of the pre-pulse laser beam may be transmitted through the beam splitter 52, and a part of the main pulse laser beam may be reflected by the second surface of the beam splitter 52. The transmitted part of the pre-pulse laser beam and the reflected part of the main pulse laser beam may be incident on a beam splitter 52*a* as sample beams.

The beam splitter 52*a* and a high-reflection mirror 52*b* may be provided in a beam path of the sample beams. The beam splitter 52*a* may reflect the pre-pulse laser beam with high reflectance and transmit the main pulse laser beam with high transmittance. The high-reflection mirror 52*b* may reflect the main pulse laser beam with high reflectance.

A beam splitter 78*a*, a focusing optical system 79*a*, a transfer optical system 80*a*, and beam profilers 56*a* and 57*a* may be provided in a beam path of the pre-pulse laser beam reflected by the beam splitter 52*a*.

The beam splitter 78*a* may be configured to transmit a part of the sample beam toward the transfer optical system 80*a* and reflect the other part toward the focusing optical system 79*a*. The transfer optical system 80*a* may transfer a beam profile at a position A1 in a beam path of the sample beam onto the photosensitive surface of the beam profiler 57*a*. The focusing optical system 79*a* may focus the sample beam reflected by the beam splitter 78*a* on the photosensitive surface of the beam profiler 56*a*. The beam profiler 56*a* may be provided at a position distanced from the focusing optical system 79*a* by a predetermined distance F. The predetermined distance F may be the focal distance of the focusing optical system 79*a*.

Each of the beam profilers 56*a* and 57*a* may output data on a beam profile such as a beam intensity distribution based on the sample beams received on the respective photosensitive surfaces thereof to a controller 90. The controller 90 may calculate a beam width of the sample beam at the position A1 from an output of the beam profiler 57*a*. Further, the controller 90 may calculate the spot width of the sample beam from an output of the beam profiler 56*a*. The controller 90 may then calculate the travel direction and the wavefront curvature of the sample beam from the calculation results.

Similarly, a beam splitter 78*b*, a focusing optical system 79*b*, a transfer optical system 80*b*, and beam profilers 56*b* and 57*b* may be provided in a beam path of the main pulse laser beam reflected by the high-reflection mirror 52*b*. Thus, the travel direction and the wavefront curvature of the main pulse laser beam may be obtained.

8. EUV LIGHT GENERATION APPARATUS IN WHICH LASER BEAM INTRODUCTION OPTICAL SYSTEM IS HOUSED IN BOX: THIRTEENTH EMBODIMENT

Figure 15A:
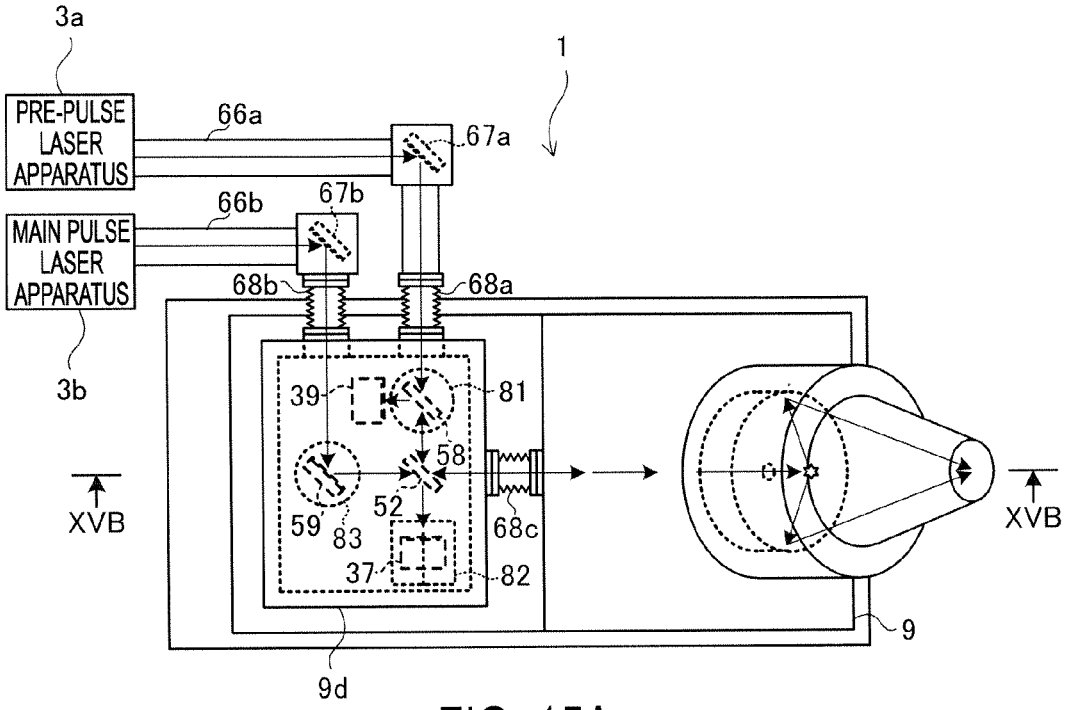
FIG. 15A is a plan view illustrating an exemplary EUV light generation apparatus according to a thirteenth embodiment of the present disclosure.
Figure 15B:
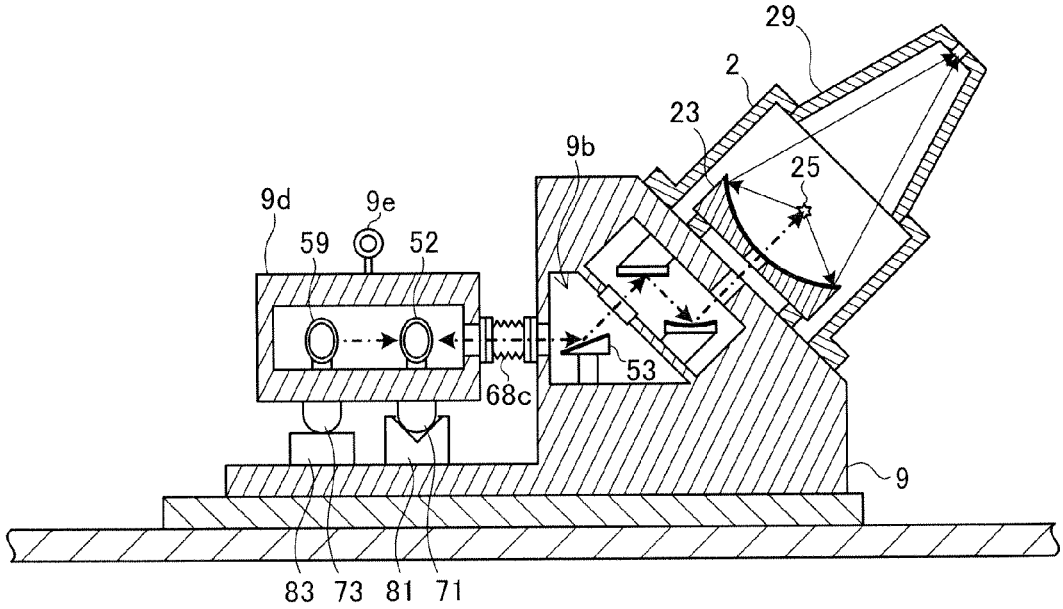
FIG. 15B is a sectional view of the EUV light generation apparatus shown in FIG. 15A, taken along XVB-XVB plane.

FIG. 15A is a plan view illustrating an EUV light generation apparatus according to a thirteenth embodiment of the present disclosure. FIG. 15B is a sectional view of the EUV light generation apparatus shown in FIG. 15A, taken along XVB-XVB plane.

In the thirteenth embodiment, a box 9*d* may be connected to the housing chamber 9*b* formed in the reference member 9 through a flexible pipe 68*c*. The high-reflection mirror 53 may be provided in the housing chamber 9*b*. The beam splitter 58, the high-reflection mirror 59, the beam splitter 52, the laser beam measuring unit 37, and the backpropagating beam measuring unit 39 may be provided in the box 9*d*.

The legs 71 through 73 may be attached on the lower surface of the box 9*d*. The leg 72 is not shown in FIG. 15B. The mounts 81 through 83 on which the legs 71 through 73 are placed may be fixed on the outer surface of the reference member 9. The leg 71 to be placed on the mount 81 having a conical recess may be provided at a position immediately underneath the beam splitter 58. The leg 72 to be placed on the mount 82 having a V-shaped groove may be provided at a position immediately underneath the laser beam measuring unit 37. The groove in the mount 82 may be formed in a direction parallel to the beam axis of the laser beam from the beam splitter 52 to the laser beam measuring unit 37 (see, e.g., 82 in FIG. 13B). Thus, the box 9*d* may be positioned to the reference member 9.

The optical pipes 66*a* and 66*b* may be attached to the box 9*d* through the flexible pipes 68*a* and 68*b*, respectively. The high-reflection mirrors 67*a* and 67*b* may be provided in the optical pipes 66*a* and 66*b*, respectively. The optical pipes 66*a* and 66*b* may be connected to the pre-pulse laser apparatus 3*a* and the main pulse laser apparatus 3*b*, respectively.

At least one eye bolt 9*e* serving as a moving mechanism may be attached to the box 9*d* to lift the box 9*d*. When maintenance work is carried out, the flexible pipe 68*c* may be detached from the box 9*d*, and a hook of a crane may be engaged with the eye bolt 9*e* to move the box 9*d* housing the laser beam introduction optical system 50.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. An apparatus for generating extreme ultraviolet light, the apparatus comprising:

a reference member;

a chamber fixed to the reference member, the chamber including at least one window;

a laser beam introduction optical system configured to introduce an externally supplied laser beam into the chamber through the at least one window; and a positioning mechanism configured to position the laser beam introduction optical system to the reference member, the positioning member including:

three legs configured to support the laser beam introduction optical system;

three mounts fixed to the reference member, the three mounts being configured to respectively support the three legs so as to position the laser beam introduction optical system on a predetermined plane; and two stoppers fixed to the reference member, the two stoppers being configured to position the laser beam introduction optical system in the predetermined plane while the three mounts respectively support the three legs.

2. The apparatus according to claim 1, further comprising a moving mechanism configured to move the laser beam introduction optical system and the three legs relative to the reference member such that the three legs respectively reach the three mounts.

3. The apparatus according to claim 2, wherein the moving mechanism includes:

a rail and a wheel moving along the rail, and the positioning system is configured to position the laser beam introduction optical system while the wheel is distance from the rail.

4. The apparatus according to claim 1, wherein the positioning mechanism includes a pressing member configured to bias the laser beam introduction optical system against both of the two stoppers.

5. The apparatus according to claim 1, further comprising two biasing members attached to the laser beam introduction optical system, one of the two biasing members having a groove formed in a direction of gravity, another one of the two biasing members having a planer surface parallel to the direction of gravity, the groove and the planer surface being respectively biased against the two stoppers so as to position the laser beam introduction optical system.

6. The apparatus according to claim 1, wherein each of the two stoppers has a columnar shape and is fixed such that an axis of each of the two stoppers coincides with a direction of gravity.

7. The apparatus according to claim 1, wherein each of the three legs has a hemispherical bottom.

8. The apparatus according to claim 1, wherein each of the three mounts has a planar upper surface.

9. The apparatus according to claim 1, further comprising two biasing members attached to the laser beam introduction optical system, one of the two biasing members having a groove formed in a direction of gravity, another one of the two biasing members having a planer surface parallel to the direction of gravity, the groove and the planer surface being respectively biased against the two stoppers so as to position the laser beam introduction optical system, wherein each of the two stoppers has a columnar shape and is fixed such that an axis of each of the two stoppers coincides with the direction of gravity.

10. The apparatus according to claim 1, wherein each of the three legs has a hemispherical bottom and each of the three mounts has a planar upper surface.

11. The apparatus according to claim 1, further comprising two biasing members attached to the laser beam introduction optical system, one of the two biasing members having a groove formed in a direction of gravity, another one of the two biasing members having a planer surface parallel to the direction of gravity, the groove and the planer surface being respectively biased against the two stoppers so as to position the laser beam introduction optical system, wherein each of the two stoppers has a columnar shape and is fixed such that an axis of each of the two stoppers coincides with the direction of gravity, and each of the three legs has a hemispherical bottom and each of the three mounts has a planar upper surface.

12. An apparatus for generating extreme ultraviolet light, the apparatus comprising:

a reference member;

a chamber fixed to the reference member, the chamber including at least one window;

a laser beam introduction optical system including a plurality of optical elements, the laser beam introduction optical system being configured to introduce at least one laser beam into the chamber through the at least one window; and a positioning mechanism including a single plate configured to support the laser beam introduction optical system, the positioning mechanism being configured to position the single plate so as to position the plurality of optical elements to the reference member.

13. The apparatus according to claim 12, wherein the moving mechanism includes:

a rail provided on the reference member; and a wheel attached to the positioning mechanism to move along the rail.

14. The apparatus according to claim 12, wherein the positioning mechanism includes an engagement unit attached to the interior of the reference member for suspending the laser beam introduction optical system.

15. The apparatus according to claim 12, wherein the plurality of optical elements include:

a beam splitter for splitting the at least one laser beam into first and second beam paths, the second beam path leading to the chamber; and a laser beam measuring unit provided in the first beam path to receive the at least one laser beam traveling through the first beam path.

16. The apparatus according to claim 12, wherein the at least one laser beam includes a pre-pulse laser beam output from a first laser apparatus and a main pulse laser beam output from a second laser apparatus, and the plurality of optical elements includes:

a beam combiner configured to control a direction of the pre-pulse laser beam and a direction of the main pulse laser beam to coincide with each other; and a laser beam measuring unit configured to receive a part of the pre-pulse laser beam output from the beam combiner and a part of the main pulse laser beam output from the beam combiner.

* * * * *